US006981390B2

(12) United States Patent
Yamada et al.

(10) Patent No.: US 6,981,390 B2
(45) **Date of Patent: *Jan. 3, 2006**

(54) REFRIGERANT CYCLE SYSTEM

(75) Inventors: Etsuhisa Yamada, Kariya (JP); Shigeki Ito, Okazaki (JP); Teruyuki Hotta, Nagoya (JP); Yasushi Yamanaka, Nakashima-gun (JP)

(73) Assignee: DENSO Corporation, Kariya (JP)

( * ) Notice: Subject to any disclaimer, the term of this patent is extended or adjusted under 35 U.S.C. 154(b) by 113 days.

This patent is subject to a terminal disclaimer.

(21) Appl. No.: 10/697,488

(22) Filed: Oct. 30, 2003

(65) Prior Publication Data

US 2004/0118150 A1 Jun. 24, 2004

(30) Foreign Application Priority Data

Oct. 30, 2002 (JP) ..... 2002-315799
Feb. 4, 2003 (JP) ..... 2003-027049
Feb. 18, 2003 (JP) ..... 2003-039924

(51) Int. Cl.
*F25B 39/04* (2006.01)
*F25B 5/00* (2006.01)
*F25B 43/00* (2006.01)
*F25B 31/00* (2006.01)
*F25B 41/00* (2006.01)

(52) U.S. Cl. ..... 62/509; 62/117; 62/503; 62/505; 62/513

(58) Field of Classification Search .... 62/500–520,117
See application file for complete search history.

(56) References Cited

U.S. PATENT DOCUMENTS 6,006,532 A * 12/1999 Suzuki et al. ..... 62/225
6,170,272 B1 * 1/2001 Backman ..... 62/117
6,427,480 B1 8/2002 Ito et al.
6,438,980 B1 * 8/2002 Sakurai et al. ..... 62/197
6,516,628 B2 * 2/2003 Izawa et al. ..... 62/509

* cited by examiner

*Primary Examiner*—Cheryl Tyler
*Assistant Examiner*—Filip Zec
(74) *Attorney, Agent, or Firm*—Harness, Dickey & Pierce, PLC

(57) ABSTRACT

A refrigerant cycle system includes a first heat-exchanging portion for condensing gas refrigerant discharged from a compressor, a gas-liquid separator into which all of refrigerant after passing through the first heat-exchanging portion and a part of gas refrigerant discharged from the compressor are introduced, and a second heat-exchanging portion for cooling and condensing refrigerant flowing from the gas-liquid separator. Because all of the condensed refrigerant from the first heat-exchanging portion is introduced into the gas-liquid separator, a passage area of a gas refrigerant introduction passage for introducing gas refrigerant from the compressor into the gas-liquid separator can be set relatively large. Therefore, a dimension difference of the gas refrigerant introducing passage in manufacturing is not greatly affected to an adjustment of a liquid refrigerant amount in the gas-liquid separator.

19 Claims, 15 Drawing Sheets

REFRIGERANT CYCLE SYSTEM

CROSS-REFERENCE TO RELATED APPLICATION

This application is related to and claims priority from Japanese Patent Applications No. 2002-315799 filed on Oct. 30, 2002, No. 2003-27049 filed on Feb. 4, 2003 and No. 2003-39924 filed on Feb. 18, 2003, the contents of which are hereby incorporated by reference.

BACKGROUND OF THE INVENTION

1. Field of the Invention

The present invention relates to a refrigerant cycle system for a vehicle air conditioner and the like. More particularly, the present invention relates to a separator-integrated condenser including first and second heat-exchanging portions and a gas-liquid separator.

2. Description of Related Art

For example, in a refrigerant cycle system disclosed in U.S. Pat. No. 6,427,480 (corresponding to JP-A-2002-323274), a condenser 302 includes first and second heat-exchanging portions 305, 306 and a gas-liquid separator 307 disposed between the first and second heat-exchanging portions 305, 306, as shown in FIG. 19. A main part of gas refrigerant discharged from a compressor 301 is introduced into the first heat-exchanging portion 305, and is condensed therein. A part of refrigerant (liquid refrigerant), condensed in the first heat-exchanging portion 305, flows into the gas-liquid separator 307 through a liquid-refrigerant bypass passage 309. At this time, a part of gas refrigerant, discharged from the compressor 301, is distributed into a gas-refrigerant bypass passage 310 having a gas refrigerant throttle 310*a*, and flows into the gas-liquid separator 307 through the gas-refrigerant bypass passage 310. In the gas-liquid separator 307, the condensed refrigerant (liquid refrigerant) from the liquid refrigerant bypass passage 309 and the discharged gas refrigerant from the gas-refrigerant bypass passage 310 are mixed and heat-exchanged with each other. Then, the mixed refrigerant is separated in the gas-liquid separator 307 into gas refrigerant and liquid refrigerant due to a mass density difference therebetween. Thus, the liquid refrigerant is stored at a lower side in the gas-liquid separator 307, and the gas refrigerant is stored at an upper side in the gas-liquid separator 307.

The second heat-exchanging portion 306 is disposed downstream of the first heat-exchanging portion 305. Specifically, a liquid-refrigerant introduction passage 311, through which a main part of liquid refrigerant condensed in the first heat-exchanging portion 305 flows, is connected to an inlet side of the second heat-exchanging portion 306. Further, a gas-refrigerant return passage 312 and a liquid-refrigerant return passage 313 are connected to the inlet side of the second heat-exchanging portion 306. In this way, the main part of liquid refrigerant condensed in the first heat-exchanging portion 305, the gas refrigerant stored at the upper side in the gas-liquid separator 307 and the liquid refrigerant stored at the lower side in the gas-liquid separator 307 are introduced into the second heat-exchanging portion 306. Then, they are super-cooled in the second heat-exchanging portion 306. The super-cooled refrigerant is decompressed by a decompression device 303 to be low-pressure gas-liquid refrigerant. The low-pressure refrigerant from the decompression device 303 is evaporated in an evaporator 304, and the evaporated refrigerant is sucked into the compressor 301.

The refrigerant cycle system was studied by the present inventors, and the following problem has been found. That is, a refrigerant flow amount in the refrigerant cycle is required to be adjusted at a predetermined target flow amount in accordance with a super-heating degree of gas refrigerant discharged from the compressor 301. Therefore, a refrigerant passage such as the gas-refrigerant bypass passage 310 having the gas refrigerant throttle 310*a* is required to be designed finely, and the condenser 302 and the gas-liquid separator 307 are also required to be formed finely in each dimension. Specifically, in the above refrigerant cycle system, apart of refrigerant (liquid refrigerant) condensed in the first heat-exchanging portion 305 flows into the gas-liquid separator 307 through the liquid-refrigerant bypass passage 309. At this time, a part of gas refrigerant discharged from the compressor 301 also flows into the gas-liquid separator 307 through the gas-refrigerant bypass passage 310. Here, a flow amount ratio between gas refrigerant and liquid refrigerant flowing into the gas-liquid separator 307 is experimentally set at a predetermined ratio so that a super-heating degree of the discharged gas refrigerant from the compressor 301 is suitably fed back into the gas-liquid separator 307. For example, a mass flow ratio of the liquid refrigerant to the discharged gas refrigerant flowing into the gas-liquid separator 307 is set at a ratio of 1:2.

In this way, since only a part of liquid refrigerant condensed in the first heat-exchanging portion 305 is circulated into the gas-liquid separator 307, only a small amount of liquid refrigerant flows into the gas-liquid separator 307. Further, the discharged gas refrigerant from the compressor 301 is circulated into the gas-liquid separator 307 by a predetermined ratio relative to the small amount of liquid refrigerant flowing thereinto. Therefore, an amount of the discharged gas refrigerant flowing from the compressor 301 into the gas-liquid separator 307 is also small. As a result, a passage diameter of the gas refrigerant throttle 310*a* of the gas-refrigerant bypass passage 310 is required to be designed at a very small dimension (e.g., Ø2.5 mm).

On the other hand, the passage diameter of the gas refrigerant throttle 310*a* generally varies from the design diameter, due to dimension variations of the passage diameter in the manufacturing process, a solder intrusion into the gas refrigerant throttle 310*a* in brazing of the condenser 302 and the like. Further, since the passage diameter of the gas refrigerant throttle 310*a* is designed at a very small dimension, an amount of the discharged gas refrigerant flowing from the compressor 301 into the gas-liquid separator 307 varies largely when the passage diameter of the gas refrigerant throttle 310*a* varies in the manufacturing process.

That is, in this case, the flow ratio of the discharged gas refrigerant flowing into the gas-liquid separator 307 to the liquid refrigerant flowing into the gas-liquid separator 307 varies largely. As a result, the flow amount of refrigerant circulated in the refrigerant cycle cannot be adjusted in accordance with the super-heating degree of the discharged gas refrigerant. For example, when the passage diameter of the gas refrigerant throttle 310*a* reduces from the design diameter due to solder intrusion and the like, the flow ratio of the discharged gas refrigerant flowing into the gas-liquid separator 307 to the liquid refrigerant flowing into the gas-liquid separator 307 is reduced. Therefore, the super-heating degree information of the gas refrigerant discharged from the compressor 301 cannot be suitably fed back into the gas-liquid separator 307, thereby extremely increasing an amount of liquid refrigerant stored in the gas-liquid separator 307. As a result, the flow amount of refrigerant circulated in the refrigerant cycle system extremely reduces relative to the super-heating degree of the discharged gas refrigerant, thereby reducing cooling performance of the refrigerant cycle system.

SUMMARY OF THE INVENTION

In view of the above problems, it is an object of the present invention to provide a refrigerant cycle system capable of adjusting a flow amount of refrigerant circulated in a refrigerant cycle by adjusting an amount of liquid refrigerant stored in the gas-liquid separator. In the refrigerant cycle system, dimension variations in manufacturing are not greatly affected to an adjustment operation of the liquid refrigerant in the gas-liquid separator.

It is another object of the present invention to simplify a refrigerant passage structure of a condenser in the refrigerant cycle system.

According to an aspect of the present invention, a refrigerant cycle system includes a first heat-exchanging portion for cooling and condensing gas refrigerant discharged from a compressor by radiating heat, a gas-liquid separator into which all of refrigerant after passing through the first heat-exchanging portion and a part of gas refrigerant discharged from the compressor are introduced, a second heat-exchanging portion disposed downstream of the first heat-exchanging portion for cooling and condensing refrigerant flowing from the gas-liquid separator by radiating heat, a gas-refrigerant return passage through which at least gas refrigerant in the gas-liquid separator is introduced into the second heat-exchanging portion, a decompression device disposed downstream of the second heat-exchanging portion for decompressing refrigerant after passing through the second heat-exchanging portion, and an evaporator disposed downstream of the decompression device for evaporating refrigerant flowing out of the decompression device. Since all of condensed refrigerant (liquid refrigerant) after passing through the first heat-exchanging portion is introduced into the gas-liquid separator, an amount of liquid refrigerant introduced into the gas-liquid separator can be increased. Therefore, an amount of gas refrigerant introduced into the gas-liquid separator can be also increased. As a result, a passage diameter of a gas-refrigerant bypass passage for regulating the gas-refrigerant introduction amount flowing into the gas-liquid separator can be effectively increased. Accordingly, even the passage diameter varies in manufacturing of the condenser, the variation ratio of the gas refrigerant amount introduced into the gas-liquid separator to the liquid refrigerant amount introduced thereinto, due to the passage diameter variation, can be effectively reduced. As a result, the adjusting operation of the liquid refrigerant amount in the gas-liquid separator is not greatly affected by the dimension variations of the gas-refrigerant bypass passage in the manufacturing. Therefore, even if dimension variations are generated in some degree, a refrigerant amount circulated in the refrigerant cycle system can be suitably adjusted in accordance with the super-heating degree of the gas refrigerant discharged from the compressor. In this case, the condenser and the gas-liquid separator are not required to be finely produced, thereby reducing production cost.

Preferably, refrigerant cycle system is provided with a gas-liquid mixing portion in which all of refrigerant after passing through the first heat-exchanging portion and a part of gas refrigerant discharged from the compressor are introduced and mixed. In this case, the gas-liquid separator has a refrigerant inlet from which refrigerant is introduced, and the gas-liquid mixing portion is connected to the refrigerant inlet of the gas-liquid separator. Specifically, first and second heat-exchanging portions are integrated to form a heat exchanging section, a first header tank and a second header tank of a condenser, the heat exchanging section includes a plurality of tubes through which refrigerant flows, the first header tank and the second header tank are disposed at two sides of the heat exchanging section to communicate with the tubes, and the gas-liquid mixing portion is provided in the first header tank.

Preferably, a passage-area adjusting device is disposed in the gas-refrigerant bypass passage for adjusting a passage area of the gas-refrigerant bypass passage. Accordingly, the passage area of the gas-refrigerant bypass passage can be suitably adjusted by the passage-area adjusting device in accordance with an actual pressure loss in the refrigerant passage of the first heat-exchanging portion.

In the present invention, an inlet portion, from which gas refrigerant discharged from the compressor is introduced into the first heat-exchanging portion, can be provided in the first heat-exchanging portion. In this case, the gas-refrigerant bypass passage and the passage-area adjusting device are provided in the first heat-exchanging portion. Alternatively, the inlet portion is provided in the gas-liquid separator, and the gas-refrigerant bypass passage and the passage-area adjusting device are provided in the gas-liquid separator.

For example, when the inlet portion is disposed outside the first heat-exchanging portion, a gas-refrigerant condensing passage through which the gas refrigerant discharged from the compressor is introduced from the inlet portion into the first heat-exchanging portion is disposed outside the first heat-exchanging portion, and a gas-refrigerant bypass passage through which the gas refrigerant discharged from the compressor is directly introduced into the gas-liquid separator while bypassing the first heat-exchanging portion, is also disposed outside the first heat-exchanging portion. Accordingly, a gas-refrigerant distribution passage (the inlet portion, the gas-refrigerant condensing passage and the gas-refrigerant bypass passage) is not required to be arranged in the first heat-exchanging portion, thereby simplifying the refrigerant passage structure of the condenser, and reducing the production cost of the condenser.

According to an another aspect of the present invention, a refrigerant cycle system includes a first heat-exchanging portion for cooling and condensing gas refrigerant discharged from the compressor by radiating heat, a gas-liquid separator into which all of refrigerant after passing through the first heat-exchanging portion is introduced, a second heat-exchanging portion disposed downstream of the first heat-exchanging portion for cooling and condensing refrigerant flowing from the gas-liquid separator by radiating heat, and a heating unit for adjusting a heating amount of the liquid refrigerant in the gas-liquid separator in accordance with any one of a super-heating degree of gas refrigerant discharged from the compressor and a super-heating degree of gas refrigerant at an outlet of the evaporator. Because all of the condensed refrigerant from the first heat-exchanging portion is introduced into the gas-liquid separator, the heating amount of the liquid refrigerant in the gas-liquid separator can be set relatively large. Therefore, the heating of the liquid refrigerant in the gas-liquid separator can be readily accurately performed.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the appended drawings.

(First Embodiment)

Figure 1:
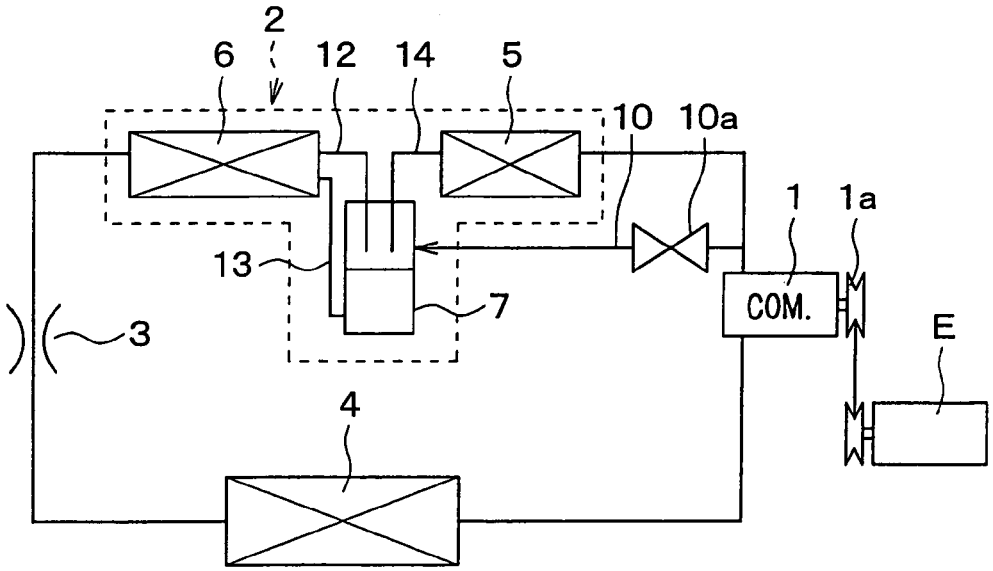
FIG. 1 is a schematic diagram showing a refrigerant cycle system according to a first embodiment of the present invention.

The first embodiment of the present invention will be now described with reference to FIGS. 1–3. In the first embodiment, a refrigerant cycle system shown in FIG. 1 is typically used for a vehicle air conditioner. In FIG. 1, a compressor 1 is driven by a vehicle engine E through a solenoid clutch 1*a* and a belt hung thereon. High-pressure and high-temperature refrigerant is discharged from the compressor 1, and is circulated into a separator-integrated condenser 2. In the condenser 2, the refrigerant is heat-exchanged with and cooled by outside air, and is condensed. The condenser 2 is disposed at a portion to be cooled by receiving running wind in a vehicle running. Specifically, the condenser 2 is disposed at a front area in an engine compartment, and is cooled by the running wind and air blown by a cooling fan (not shown).

A decompression device 3 decompresses refrigerant after passing through the condenser 2 to a low-pressure and gas-liquid refrigerant state. For example, the decompression device 3 is constructed with a fixed throttle such as an orifice, a nozzle and a capillary tube. The decompression device 3 may be constructed with a variable throttle capable of adjusting its open degree in accordance with pressure and a temperature of high-pressure refrigerant. An evaporator 4 is disposed to evaporate the low-pressure refrigerant flowing out of the decompression device 3 by absorbing heat from air blown by a blower (not shown) of the vehicle air conditioner. The evaporator 4 is disposed in an interior unit case (not shown) of the vehicle air conditioner to cool air flowing in the interior unit case. Air cooled by the evaporator 4 is temperature-adjusted by a heater core (not shown), and is blown into a passenger compartment. On the other hand, gas refrigerant evaporated in the evaporator 4 is sucked into the compressor 1.

The separator-integrated condenser 2 includes a first heat-exchanging portion 5 and a second heat-exchanging portion 6 disposed in this order in a refrigerant flowing direction. Further, the condenser 2 includes a gas-liquid separator 7 at a high pressure side, for separating refrigerant into gas refrigerant and liquid refrigerant, between the first and second heat-exchanging portions 5, 6. A liquid-refrigerant introduction passage 14, through which all of liquid refrigerant (condensed refrigerant) after passing through the first heat-exchanging portion 5 is introduced into the gas-liquid separator 7, is provided between the gas-liquid separator 7 and the first heat-exchanging portion 5. A part of gas refrigerant discharged from the compressor 1 is introduced into a gas-refrigerant bypass passage 10 having a gas refrigerant throttle 10*a*, and is introduced from the gas-refrigerant bypass passage 10 into the gas-liquid separator 7.

In the gas-liquid separator 7, the liquid refrigerant from the liquid-refrigerant introduction passage 14 and the discharged gas refrigerant from the gas-refrigerant bypass passage 10 are mixed with each other, and the mixed refrigerant is separated into gas refrigerant and liquid refrigerant due to a mass density difference between gas refrigerant and liquid refrigerant. The liquid refrigerant is stored at a lower portion in the gas-liquid separator 7, and the gas refrigerant is stored at an upper portion therein. A gas-refrigerant return passage 12, through which gas refrigerant is introduced from the gas-liquid separator 7 into the second heat-exchanging portion 6, is connected to an inlet side of the second heat-exchanging portion 6. Further, a liquid-refrigerant return passage 13, through which liquid refrigerant is introduced from the gas-liquid separator 7 into the second heat-exchanging portion 6, is connected to the inlet side of the second heat-exchanging portion 6.

Next, a specific construction of the separator-integrated condenser 2 with the gas-liquid separator 7 will be described with reference to FIGS. 2, 3. The condenser 2 includes a heat-exchanging portion 8 constructed with plural flat tubes 15 horizontally extending and forming a refrigerant passage and, corrugated fins 16 connected to the plural flat tubes 15. The first and second heat-exchanging portions 5, 6 are integrally connected to form the heat-exchanging portion 8. Right and left header tanks (side tanks) 17, 18 are disposed at right and left sides of the heat-exchanging portion 8, respectively, to extend in an up-down direction. Right and left ends of each flat tube 15 are connected to and communicate with the right and left header tanks 17, 18, respectively.

An inner space of the left header tank 17 is partitioned by two partition plates 19*a*, 19*b* into upper, intermediate and lower spaces 17*a*, 17*b*, 17*c*. The upper partition plate 19*a* has a throttle opening that is as the gas refrigerant throttle 10*a*. An inner space of the right header tank 18 is partitioned by a partition plate 20 into upper and lower spaces 18*a*, 18*b*. The lower partition plate 19*b* in the header tank 17 and the partition plate 20 in the header tank 18 are arranged at the same height position in an up-down direction of the header tanks 17, 18. The first heat-exchanging portion 5 is arranged in an upper side area of the heat-exchanging portion 8, specifically, at an upper portion of both the partition plates 19*b*, 20. The second heat-exchanging portion 6 is arranged in a lower side area of the heat-exchanging portion 8, specifically, at a lower portion of both the partition plates 19*b*, 20.

An inlet joint 24 used as a refrigerant inlet is connected to the left header tank 17 at a portion corresponding to the intermediate space 17*b*. The gas refrigerant, discharged from the compressor 1, flows from the inlet joint 24 into the intermediate space 17*b* of the left header tank 17. A part of the gas refrigerant, flowing into the intermediate space 17*b* from the compressor 1, directly flows into the upper space 17*a* through the gas refrigerant throttle 10*a* opened in the upper partition plate 19*a*. That is, the part of the discharged gas refrigerant flows into the upper space 17*a* while bypassing the first heat-exchanging portion 5. A flow amount (bypass amount) of refrigerant flowing from the intermediate space 17*b* into the upper space 17*a* is set by an opening area of the gas refrigerant throttle 10*a*. Further, upper and lower connection joints 17*d*, 17*e* are integrated to the left header tank 17 around upper and lower ends of the left header tank 17, respectively. The upper and lower connection joints 17*d*, 17*e* have passage holes 17*f*, 17*g* communicating with the upper and lower spaces 17*a*, 17*c* of the left header tank 17 and screw holes 17*h*, 17*i*, respectively. An outlet joint 25 is connected to the right header tank 18 at a lower side to communicate with the lower space 1818*b* of the right header tank 18. Refrigerant from the lower space 18*b* of the right header tank 18 flows toward the decompression device 3 through the outlet joint 25.

The gas-liquid separator 7 is constructed with a cylindrical tank member extending in the up-down direction, and is fixed to the connection joints 17*d*, 17*e* of the left header tank 17 having the inlet joint 24. Specifically, the gas-liquid separator 7 has through holes 71, 72 horizontally provided around its upper and lower ends, respectively. Top end portions of screw portions of bolts 73, 74 are screwed into the screw holes 17*h*, 17*i* of the connection joints 17*d*, 17*e* through the through holes 71, 72, respectively. In this way, the gas-liquid separator 7 is fixed to one of the header tanks 17, 18, that is, the left header tank 17 in this example. The gas-liquid separator 7 has a refrigerant inlet 75 and a refrigerant outlet 76 around its upper and lower ends, respectively. The refrigerant inlet 75 is disposed so as to face the passage hole 17*f* of the upper connection joint 17*d*, and the refrigerant outlet 76 is disposed so as to face the passage hole 17*g* of the lower connection joint 17*e*. Therefore, when the gas-liquid separator 7 is fixed to the left header tank 17, the refrigerant inlet 75 and the refrigerant outlet 76 can be connected to the passage hole 17*f* of the upper connection joint 17*d* and the passage hole 17*g* of the lower connection joint 17*e*, respectively, at the same time. Here, sealing performance of each connection portion of the refrigerant inlet 75 and the refrigerant outlet 76 is ensured by an elastic seal member such as an O-ring.

Figure 3:
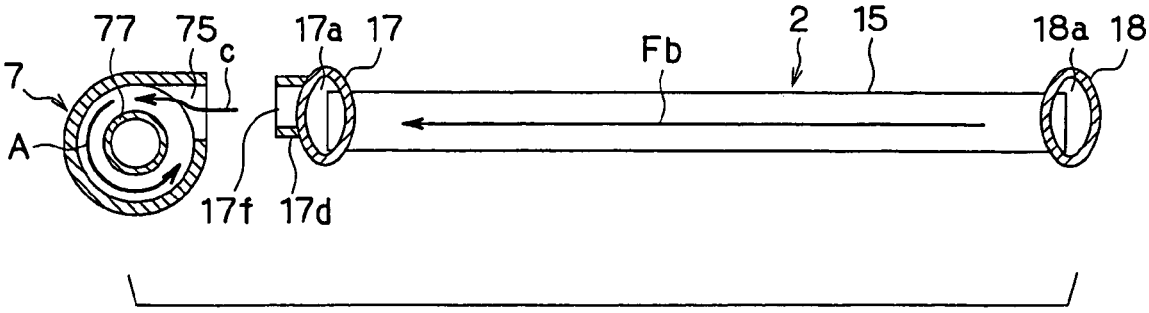
FIG. 3 is a schematic sectional view showing a refrigerant inlet portion of the gas-liquid separator in the separator-integrated condenser according to the first embodiment.

As shown in FIG. 3, the refrigerant inlet 75 is disposed so as to be offset from a circular center of an inner space of the gas-liquid separator 7. Therefore, refrigerant flows from the refrigerant inlet 75 into the inner space of the gas-liquid separator 7 substantially along a tangential line of a circular inner peripheral surface of the inner space. Therefore, as shown in FIG. 3, the refrigerant flows in a turn flow A in an upper inner space of the gas-liquid separator 7, and centrifugal force is applied to the refrigerant flow due to this turn flow A. Thus, liquid refrigerant (saturated liquid refrigerant) having larger mass density is pushed to the inner peripheral surface of the gas-liquid separator 7. Then, the liquid refrigerant drops along the inner peripheral surface, and is stored in the inner space of the gas-liquid separator 7 at the lower side. In FIG. 2, the line B shows a liquid surface of the liquid refrigerant in the gas-liquid separator. On the contrary, gas refrigerant (saturated gas refrigerant) having lower mass density collects around the circular center of the inner space of the gas-liquid separator 7. Thus, a gas refrigerant area is provided in the inner space of the gas-liquid separator 7 at an upper side, that is, at an upper side of the liquid surface B of the liquid refrigerant in the gas-liquid separator 7.

Thus, the refrigerant, flowing from the refrigerant inlet 75 into the gas-liquid separator 7, is forced to be separated into liquid refrigerant and gas refrigerant, by using the centrifugal force of the turn flow A. Therefore, even if the gas-liquid separator 7 has only a small tank capacity, the refrigerant flowing into the gas-liquid separator 7 can be surely separated into liquid refrigerant and gas refrigerant. Thus, a centrifugal separator is constructed at an upper portion of the gas-liquid separator 7 around the refrigerant inlet 75.

A circular pipe member 77 is disposed at a circular center area of the circular inner space of the gas-liquid separator 7 so as to extend in the up-down direction. The pipe member 77 has a gas return opening 77*a* from which gas refrigerant is sucked. The gas return opening 77*a* is provided in an outer peripheral surface of the pipe member at a position much higher than the liquid surface B of the liquid refrigerant. The gas refrigerant flows downward in an inner passage of the pipe member 77. Further, the pipe member 77 has a liquid return opening 77*b*, from which liquid refrigerant is sucked. The liquid return opening 77*b* is provided in the outer peripheral surface of the pipe member 77 at a position much lower than the liquid surface B of the liquid refrigerant. The liquid refrigerant is sucked into the inner passage of the pipe member 77, and is mixed with the gas refrigerant sucked therein.

A circular plate member 77*c* having a center hole is fixed onto an outer peripheral surface of the pipe member 77 at a position slightly lower than the gas return opening 77*a*. A predetermined clearance is provided between the outer peripheral surface of the circular plate member 77*c* and the inner peripheral surface of the gas-liquid separator 7. Liquid refrigerant generated at the upper side area of the gas-liquid separator 7 drops along its inner peripheral surface through this clearance. Because the plate member 77*c* is provided, the liquid refrigerant with the liquid surface B in the gas-liquid separator 7 can be restricted from bubbling, thereby improving separating performance between the gas refrigerant and the liquid refrigerant in the gas-liquid separator 7. The gas-liquid separator 7 has a cylindrical wall portion 78 at its bottom, and the bottom wall portion 78 has the through hole 72 horizontally provided at its bottom side and a hole portion 79 provided at an upper side of the through hole 72 in the up-down direction. A lower end of the pipe member 77 is inserted and fixed into an upper portion (large hole portion) of the hole portion 79 while an upper end of the pipe member 77 contacts an upper wall surface of the gas-liquid separator 7. A lower portion of the hole portion 79 communicates with the refrigerant outlet 76. Accordingly, refrigerant flows from the gas return opening 77*a* and the liquid return opening 77*b* into the pipe member 77, and further flows into the refrigerant outlet 76 through the hole portion 79.

Figure 2:
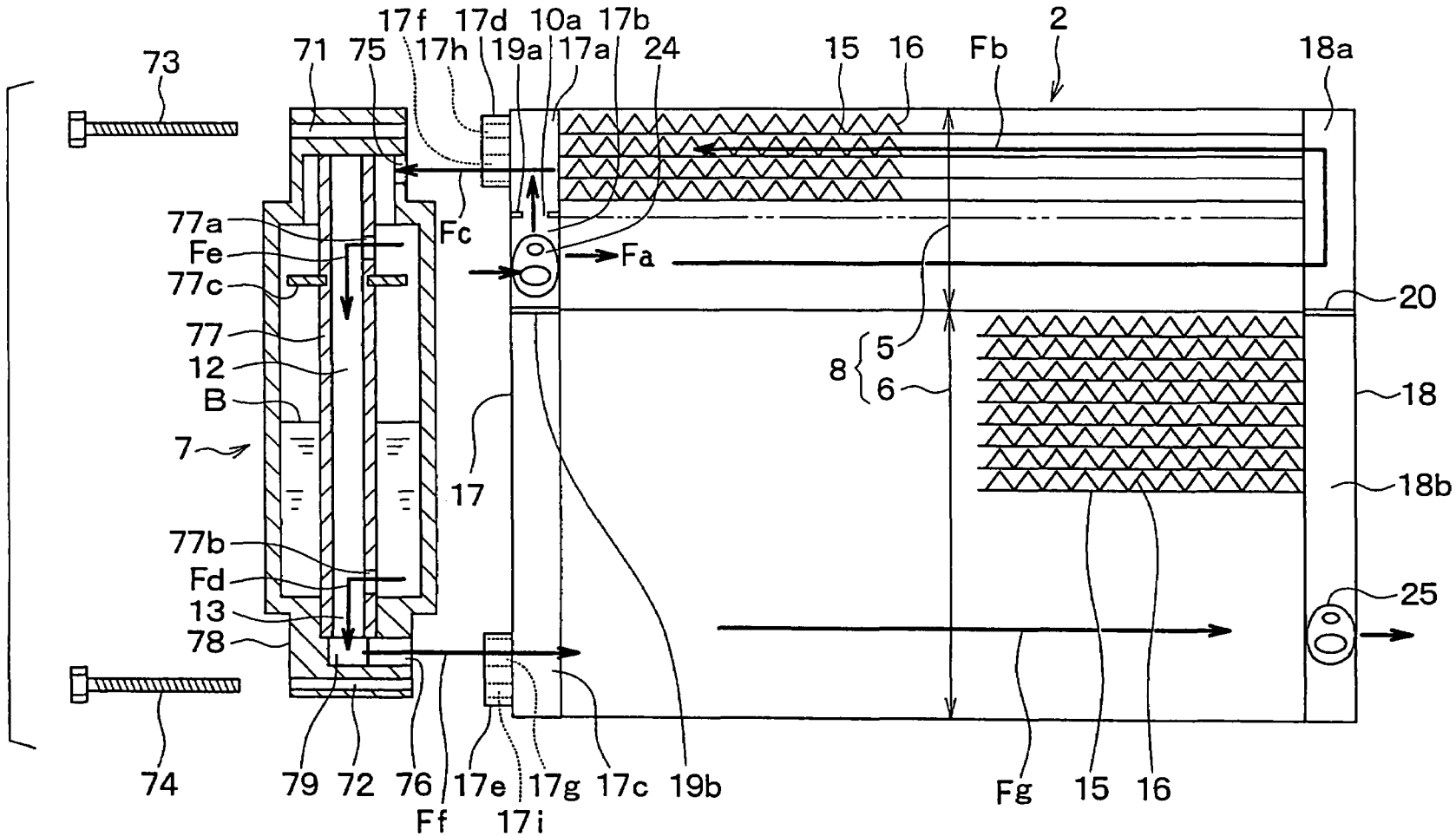
FIG. 2 is a schematic sectional view showing a disassembled state of a separator-integrated condenser with a gas-liquid separator according to the first embodiment.

In FIG. 2, the bottom wall portion 78 is integrated to the gas-liquid separator 7. However, actually, the bottom wall portion 78 is formed as a cover member separated from the gas-liquid separator 7, and is inserted into the gas-liquid separator 7. A desiccant (not shown) for absorbing water contained in refrigerant is disposed in the gas-liquid separator 7. All of the flat tubes 15 of the heat-exchanging portion 8 (first and second heat-exchanging portions 5, 6), the corrugated fins 16, the header tanks 17, 18, the connection joints 17*d*, 17*e*, the inlet joint 24, the outlet joint 25 and the like are made of aluminum, and are integrated together by brazing.

Next, operation of the separator-integrated condenser 2 in the first embodiment will be described. Gas refrigerant is discharged from the compressor 1, and flows from the inlet joint 24 into the intermediate space 17*b* of the left header tank 17. As indicated by the arrow Fa in FIG. 2, a main part of the gas refrigerant discharged from the compressor 1 flows into the flat tubes 15 at a lower half portion of the first heat-exchanging portion 5, and passes therethrough horizontally. Then, the main part of the discharged gas refrigerant is U-turned in the upper space 18*a* of the header tank 18, and flows into the flat tubes 15 at an upper half portion of the first heat-exchanging portion 5 horizontally as shown by the arrow Fb. In a normal cycle operation condition, the gas refrigerant discharged from the compressor 1 radiates heat to outside air, and is condensed while flowing in a U-turn refrigerant passage of the first heat-exchanging portion 5. Therefore, the condensed refrigerant (liquid refrigerant) flows into the upper space 17*a* of the left header tank 17. When the cycle operation condition changes, gas-liquid refrigerant, having a predetermined dry degree, sometimes flows into the upper space 17*a*.

On the other hand, a part of the discharged gas refrigerant flowing from the compressor 1 into the intermediate space 17*b* passes through the gas refrigerant throttle 10*a* of the upper partition plate 19*a*, and directly flows into the upper space 17*a* of the left header tank 17. Accordingly, the part of the discharged gas refrigerant and the condensed refrigerant (liquid refrigerant) after passing through the first heat-exchanging portion 5 are mixed in the upper space 17*a* of the left header tank 17. As indicated by the arrow Fc in FIG. 2, the mixed refrigerant passes through the passage hole 17*f* of the upper connection joint 17*d*, and flows into the refrigerant inlet 75 of the gas-liquid separator 7. The refrigerant flowing into the refrigerant inlet 75 is separated by the centrifugal separator into liquid refrigerant (saturated liquid refrigerant) and gas refrigerant (saturated gas refrigerant). The liquid refrigerant drops in the gas-liquid separator 7, and is stored therein at the lower side area. As indicated by the arrow Fd in FIG. 2, a part of the stored liquid refrigerant flows into the pipe member 77 from the liquid return opening 77*b* located around the lower end of the pipe member 77. As indicated by the arrow Fe in FIG. 2, the gas refrigerant flows into the inner space of the pipe member 77 from the gas return opening 77*a*.

An open area of the liquid return opening 77*b* is set much smaller than an open area of the gas return opening 77*a*, thereby restricting liquid refrigerant flowing into the liquid return opening 77*b*. The gas refrigerant and the liquid refrigerant flows from the pipe member 77 into the lower space 17*c* of the left header tank 17 through the hole portion 79, the refrigerant outlet 76 and the passage hole 17*g* of the lower connection joint 17*e* in this order, as indicated by the arrow Ff in FIG. 2.

The gas refrigerant and the liquid refrigerant are mixed in the refrigerant passage, and pass through the flat tubes 15 in the second heat-exchanging portion 6 as indicated by the arrow Fg in FIG. 2. While the refrigerant passes through the flat tubes 15 in the second heat-exchanging portion 6, the refrigerant further radiates heat to outside air to be super-cooled, and flows into the lower space 18*b* of the left header tank 18. Thereafter, the super-cooled refrigerant flows outside of the condenser 2 from the outlet joint 25, and flows toward the decompression device 3. A part of the liquid refrigerant, stored in the gas-liquid separator 7, is always introduced into the second heat-exchanging portion 6, and is circulated into the refrigerant cycle. Therefore, lubricating oil contained in liquid refrigerant is surely returned into the compressor 1, thereby improving lubricating performance of the compressor 1.

In order to form the above-described refrigerant flow, all of the condensed refrigerant (liquid refrigerant) after passing through the first heat-exchanging portion 5 and the part of the discharged gas refrigerant flowing from the inlet joint 24 into the left header tank 17 are mixed and heat-exchanged with each other in the upper space 17*a* of the left header tank 17. In this way, the refrigerant, flowing from the upper space 17*a* into the gas-liquid separator 7, is in the gas-liquid two-phase state having a dry degree corresponding to a super-heating degree of the discharged gas refrigerant of the compressor 1.

As a result, the amount of liquid refrigerant stored in the gas-liquid separator 7 is an amount corresponding to the super-heating degree of the gas refrigerant discharged from the compressor 1. That is, the amount of liquid refrigerant stored in the gas-liquid separator 7 can be adjusted in accordance the change of the super-heating degree of the gas refrigerant discharged from the compressor 1. An amount of the gas refrigerant, introduced from the gas-liquid separator 7 into the second heat-exchanging portion 6, is changed by adjusting this liquid refrigerant amount stored in the gas-liquid separator, thereby adjusting an amount of refrigerant circulated in the refrigerant cycle and adjusting the super-heating degree of the gas refrigerant discharged from the compressor 1. Since the compression of the compressor 1 is performed with an isentropic change basically, if the superheating degree of the gas refrigerant discharged from the compressor 1 can be controlled, the super-heating degree of the gas refrigerant at an outlet of the evaporator 4 can be also controlled. In this way, in the first embodiment, dimension difference of the refrigerant passage in manufacturing is not greatly affected to the adjustment operation of refrigerant amount in the refrigerant cycle system where the flow amount of a circulated refrigerant is adjusted by adjusting the amount of liquid refrigerant stored in the gas-liquid separator 7 arranged at the high pressure side.

Next, advantages of the first embodiment will be specifically described. A flow amount ratio between the condensed refrigerant (liquid refrigerant) introduced into the gas-liquid separator 7 and the gas refrigerant introduced into the gas-liquid separator 7 from the compressor 1 is set at a predetermined ratio suitable for the refrigerant cycle system so that the super-heating information of the gas refrigerant discharged from the compressor 1 can be suitably fed back into the gas-liquid separator 7. For example, as described above, the flow amount ratio of the liquid refrigerant to the gas refrigerant flowing into the gas-liquid separator 7 is set about 1:2. In the first embodiment, all of the condensed refrigerant after passing through the first heat-exchanging portion 5 is introduced into the gas-liquid separator 7. Therefore, in the first embodiment, an amount of the liquid refrigerant flowing into the gas-liquid separator 7 can be effectively increased. Therefore, the amount of the gas refrigerant flowing from the compressor 1 into the gas-liquid separator 7 can be also effectively increased.

As a result, a passage diameter of the gas refrigerant throttle 10*a*, for regulating the amount of the gas refrigerant flowing from the compressor into the gas-liquid separator 7, can be increased to a dimension (e.g., Ø5.5 mm). The passage diameter of ϕ5.5 mm in the first embodiment is larger than twice of the passage diameter (Ø2.5 mm) in the above-described related art. Here, when the passage diameter of the gas refrigerant throttle 10*a* is machined, dimension difference of the passage diameter of the gas refrigerant throttle 10*a* is caused in the machining. Further, the passage diameter of the gas refrigerant throttle 10*a* is changed by solder invasion into the gas refrigerant throttle 10*a* in brazing of the condenser 2 and the like. Therefore, the passage diameter of the gas refrigerant throttle 10*a* actually formed is generally changed to a some degree from the design diameter.

However, in the first embodiment, the passage diameter of the gas refrigerant throttle 10*a* can be largely increased than in the related art. Therefore, even when the passage diameter of the gas refrigerant throttle 10 is changed in the manufacturing step, a change ratio of the passage diameter can be effectively reduced. That is, a flow amount change of the gas refrigerant in the gas refrigerant throttle 10*a* due to the dimension difference in the passage diameter can be effectively. Therefore, the flow-amount change ratio of the gas refrigerant to the liquid refrigerant flowing into the gas-liquid separator 7 can be reduced, and the dimension difference of the refrigerant passage in the manufacturing step is not greatly affected to the adjustment operation of the refrigerant flow amount in the refrigerant cycle. Accordingly, even if the passage dimension changes in the manufacturing step by some degree, the refrigerant amount circulated in the refrigerant cycle can be suitably adjusted to a predetermined target amount in accordance with the super-heating degree of the discharged gas refrigerant from the compressor 1.

Next, the correlation between the specific construction shown FIGS. 2, 3 and the refrigerant circuit construction shown in FIG. 1 will be described. The gas-refrigerant bypass passage 10 shown in FIG. 1 is constructed with the gas refrigerant throttle 10*a*, the upper space 17*a* of the left header tank 17 and the passage hole 17*f* of the upper connection joint 17*d* shown in FIGS. 2, 3. The liquid-refrigerant introduction passage 14 in FIG. 1 is constructed with the upper space 17*a* of the left header tank 17 and the passage hole 17*f* of the upper connection joint 17*d* shown FIGS. 2, 3. The gas-refrigerant return passage 12 shown in FIG. 1 is constructed with the gas return opening 77*a*, the inner passage of the pipe member 77, the hole portion 79, the refrigerant outlet 76 and the passage hole 17*g* of the lower connection joint 17*e* shown in FIGS. 2, 3. The liquid-refrigerant return passage 13 shown in FIG. 1 is constructed with the liquid return opening 77*b*, the inner passage of the pipe member 77, the hole portion 79, the refrigerant outlet 76 and the passage hole 17*g* of the lower connection joint 17*e* shown in FIGS. 2, 3. Here, the upper space 17*a* of the header tank 17 is used as a refrigerant mixing portion for mixing the gas refrigerant from the compressor 1 and the liquid refrigerant from the first heat-exchanging portion 5, in the present invention.

(Second Embodiment)

Figure 4A:
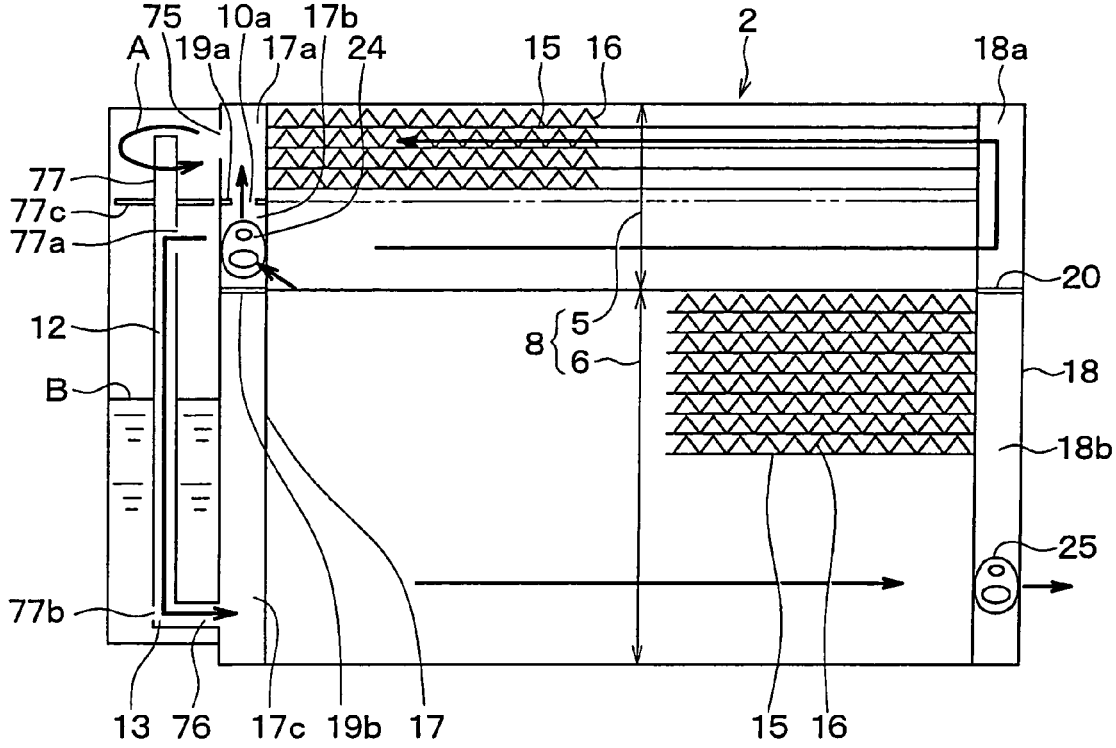
FIG. 4A is a schematic sectional view showing a separator-integrated condenser with a gas-liquid separator according to a second embodiment of the present invention.
Figure 4B:
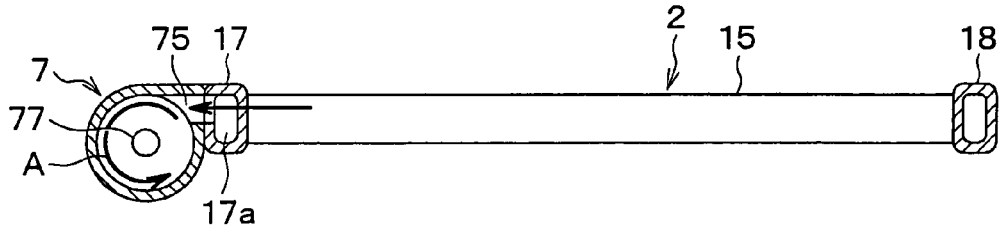
FIG. 4B is a schematic sectional view showing a refrigerant inlet portion of the gas-liquid separator in the separator-integrated condenser according to the second embodiment.

In the above-described first embodiment, the gas-liquid separator 7 is fixed by using the bolts 73, 74 to the left header tank 17 of the condenser 2. However, in the second embodiment, as shown in FIG. 4, the gas-liquid separator 7 is integrally brazed to the left header tank 17 of the condenser 2. Specifically, the gas-liquid separator 7 has a flat outer-wall surface on a side having the refrigerant inlet 75. That is, the gas-liquid separator 7 has a flat outer-wall surface that is bonded to the left header tank 17 by the brazing. The gas-liquid separator 7 is integrally brazed to the left header tank 17 while its flat outer-wall surface contacts an outer wall surface of the left header tank 17. Therefore, in the second embodiment, the components such as the connection joints 17*d*, 17*e* and the bolts 73, 74 in the first embodiment can be eliminated, thereby simplifying the construction, and eliminating screwing work of the bolts 73, 74. In the second embodiment, the gas-liquid separator 7 may be brazed to the left header tank 17 through a both-surface clad material. That is, the both-surface clad material is clad with a brazing material on both the surfaces, and is disposed between the flat outer-wall surface of the gas-liquid separator 7 and the flat outer-wall surface of the left header tank 17. In the second embodiment, the other parts are similar to those of the above-described first embodiment, and the description thereof is omitted.

(Third Embodiment)

Figure 5:
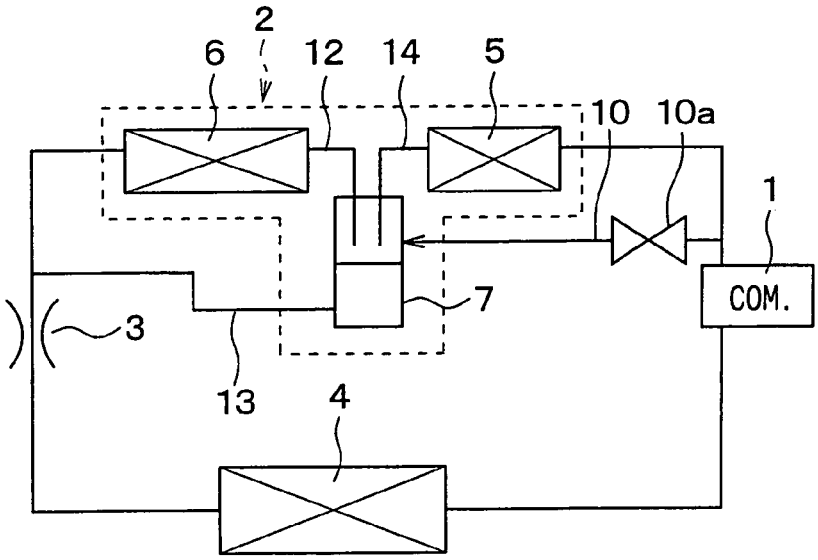
FIG. 5 is a schematic diagram showing a refrigerant cycle system according to a third embodiment of the present invention.

In the above-described first and second embodiments, the liquid-refrigerant return passage 13 into which a part of liquid refrigerant stored in the gas-liquid separator 7 flows, is connected to the inlet side of the second heat-exchanging portion 6. However, in the third embodiment, as shown in FIG. 5, the liquid-refrigerant return passage 13 is connected to the outlet side of the second heat-exchanging portion 6. Further, as in the second embodiment, the gas-liquid separator 7 is integrally brazed to the left header tank 17.

Figure 6A:
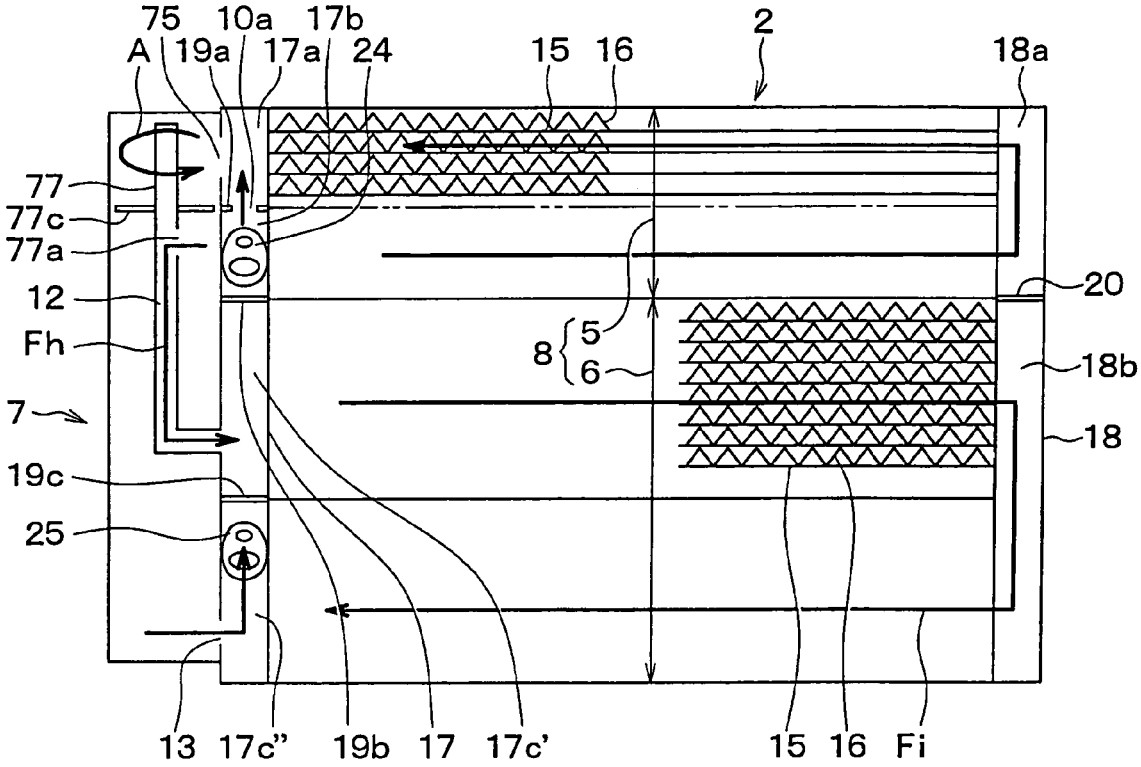
FIG. 6A is a schematic sectional view showing a separator-integrated condenser with a gas-liquid separator according to the third embodiment.

In the third embodiment, as shown in FIG. 6A, three partition plates 19*a*, 19*b*, 19*c* are arranged in the up-down direction in the left header tank 17 of the condenser 2, thereby partitioning the inner space of the left header tank 17 into four spaces 17*a*, 17*b*, 17*c*', 17*c*" in the up-down direction. The partition plates 19*a*, 19*b*, the upper space 17*a* and the intermediate space 17*b* in the third embodiment correspond to those in the first and second embodiments, respectively. On the other hand, the partition plate 19*c* in the third embodiment is newly added to the header tank 17 the first and second embodiments. Therefore, the lower space 17*c* in the first and second embodiments is partitioned by the partition plate 19*c* into an intermediate space 17*c*' and a lowest space 17*c*" in the third embodiment.

In the third embodiment, the pipe member 77 is formed into L-shape, and the lower outlet of the L-shaped pipe member 77 communicates with the intermediate space 17*c*'. Therefore, the L-shaped pipe member 77 is used as the gas-refrigerant return passage 12 shown in FIG. 5. On the other hand, the outlet joint 25 is disposed on the left header tank 17 at a position corresponding to the lowest space 17*c*" under the partition plate, and a part of liquid refrigerant stored in the gas-liquid separator 7 is introduced through the liquid-refrigerant return passage 13 into the lowest space 17*c*". The liquid-refrigerant return passage 13 can be constructed with a though hole penetrating through a wall between the gas-liquid separator 7 and the left header tank 17.

In the third embodiment, the refrigerant is centrifuged into gas refrigerant and liquid refrigerant in the gas-liquid separator 7. The gas refrigerant collected at the upper side in the gas-liquid separator 7 flows into the pipe member 77 from the gas return opening 77*a* located at the upper side of the pipe member 77. Then, the gas refrigerant flows in the inner space of the pipe member 77 as indicated by the arrow Fh in FIG. 6A, and flows into the intermediate space 17*c*'. The intermediate space 17*c*' is provided to define an inlet portion of the second heat-exchanging portion 6. The gas refrigerant flows from the intermediate space 17*c*' into the flat tubes 15 in the upper portion of the second heat-exchanging portion 6, and is U-turned in the lower space 18*b* of the header tank 18 as indicated by the arrow Fi in FIG. 6A. Then, the refrigerant flows into the flat tubes 15 in the lower portion of the second heat-exchanging portion 6, and flows into the lowest space 17*c*" of the left header tank 17.

In the third embodiment, a U-shaped refrigerant passage is formed also in the second heat-exchanging portion 6, and the saturated gas refrigerant radiates heat to outside air in the U-shaped refrigerant passage. Thus, the saturated gas refrigerant is condensed and super-cooled in the U-shaped refrigerant passage of the second heat-exchanging portion 6, and flows into the lowest space 17*c*". In the lowest space 17*c*", the super-cooled liquid refrigerant from the second heat-exchanging portion 6 and the saturated liquid refrigerant from the gas-liquid separator 7 through the liquid-refrigerant return passage 13 are mixed. The mixed refrigerant flows outside from the condenser 2 through the outlet joint 25, and flows toward the inlet side of the decompression device 3. In the third embodiment, because the U-shaped refrigerant passage is constructed also in the second heat-exchanging portion 6, the number of turns in the refrigerant passage can be increased in the condenser 2, and heat-exchanging performance in the condenser 2 can be improved.

(Fourth Embodiment)

Figure 7:
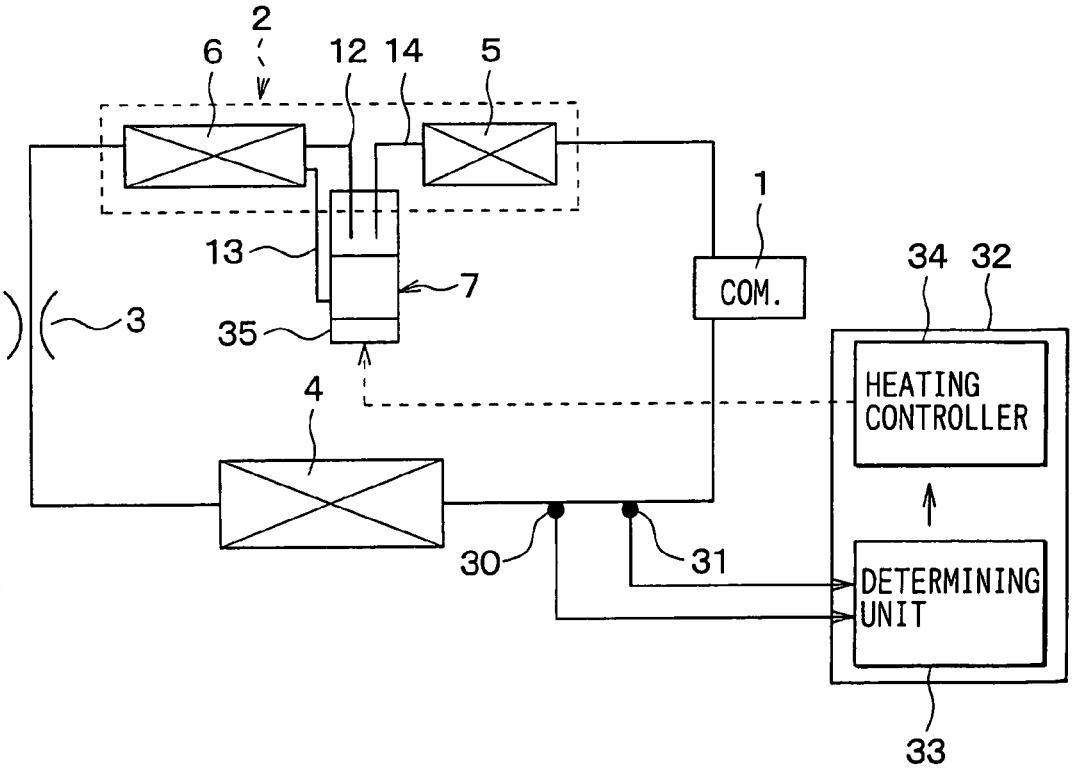
FIG. 7 is a schematic diagram showing a refrigerant cycle system and an electronic control unit according to a fourth embodiment of the present invention.

In the above-described first to third embodiments, a part of gas refrigerant discharged from the compressor 1 is directly introduced into the gas-liquid separator 7, thereby changing an amount of liquid refrigerant stored in the gas-liquid separator 7 in accordance with a change of the super-heating degree of the discharged gas refrigerant from the compressor 1. However, in the fourth embodiment, as shown in FIG. 7, the gas refrigerant from the compressor 1 is not directly introduced into the gas-liquid separator 7, and a heating device 35 is provided. The heating device 35 adjusts a refrigerant heating amount in accordance with the super-heating degree of gas refrigerant at the outlet of the evaporator 4, thereby adjusting the amount of liquid refrigerant stored in the gas-liquid separator 7. In the fourth embodiment, the heating device 35 is constructed with an electric heater.

Specifically, in the fourth embodiment, as shown in FIG. 7, the gas-refrigerant bypass passage 10 having the gas refrigerant throttle 10*a* is eliminated from the refrigerant passage in the separator-integrated condenser 2 shown in FIG. 1 (in the first embodiment). Further, in the fourth embodiment, a refrigerant temperature sensor 30 and a refrigerant pressure sensor 31 are provided on a refrigerant outlet pipe of the evaporator 4, and the electric heater 35 is provided on the gas-liquid separator 7 at its bottom side. Detection signals from the both the sensors 30, 31 are input to a super-heating degree determining unit (determining unit) 33 of an electronic control unit 32, and the super-heating degree determining unit 33 determines the super-heating degree of gas refrigerant at the outlet of the evaporator 4. A super-heating degree determining signal is output from the super-heating degree determining unit 33 to a heating-amount control unit (heating controller) 34 of the electronic control unit 32.

The heating-amount control unit 34 controls an electric current supplied to the electric heater 35 so as to increase a heating amount of the electric heater 35 as the super-heating degree of gas refrigerant at the outlet of the evaporator 4 increases. The heating amount of the electric heater 35 is increased as the super-heating degree of gas refrigerant at the outlet of the evaporator 4 increases, thereby increasing an evaporation amount of liquid refrigerant stored in the gas-liquid separator 7. Therefore, an amount of refrigerant circulated in the refrigerant cycle is increased as the super-heating degree of gas refrigerant at the outlet of the evaporator 4 increases, thereby preventing the super-heating degree from increasing. On the contrary, when the super-heating degree of gas refrigerant at the outlet of the evaporator 4 reduces, the heating amount of the electric heater 35 is reduced. Therefore, an evaporation amount of liquid refrigerant stored in the gas-liquid separator 7 is reduced, that is, an amount of liquid refrigerant stored in the gas-liquid separator 7 is increased, thereby preventing the super-heating degree of gas refrigerant at the outlet of the evaporator 4 from reducing.

In the fourth embodiment, the heating amount for heating the liquid refrigerant stored in the gas-liquid separator 7 is electrically adjusted in accordance with the super-heating degree of gas refrigerant at the outlet of the evaporator 4, thereby controlling the super-heating degree of gas refrigerant at the outlet of the evaporator 4 in a predetermined super-heating area.

Even in the fourth embodiment, all of the condensed liquid refrigerant after passing through the first heat-exchanging portion 5 is introduced into the gas-liquid separator 7 through the liquid-refrigerant introduction passage 14. Therefore, an amount of liquid refrigerant introduced into the gas-liquid separator 7 can be increased. Further, as the amount of liquid refrigerant introduced into the gas-liquid separator 7 increases, the heating amount of the electric heater 35 can be set relatively larger. As a result, even if the heating amount of the electric heater 35 deviates from a suitable heating amount due to detection errors of both the sensors 30, 31 and the likes, a deviation ratio between an actual heating amount and the suitable heating amount can be reduced. Accordingly, the adjusting operation of a refrigerant amount circulated in the refrigerant cycle is not largely affected by the heating-amount deviation of the electric heater 35. Thus, the super-heating control of gas refrigerant at the outlet of the evaporator 4 can be performed even when the heating-amount deviation of the electric heater 35 is caused.

In the fourth embodiment, the super-heating degree of the gas refrigerant at the outlet of the evaporator 4 is determined, and the heating amount of the electric heater 35 for heating liquid refrigerant stored in the gas-liquid separator 7 is controlled, thereby directly controlling the super-heating degree of gas refrigerant at the outlet of the evaporator 4. However, the refrigerant temperature sensor 30 and the refrigerant pressure sensor 31 may be provided at the discharge side of the compressor 1. In this case, the super-heating degree of gas refrigerant discharged from the compressor 1 is determined, and the heating amount of the electric heater 35 is controlled, thereby controlling the super-heating degree of gas refrigerant discharged from the compressor 1, and indirectly controlling the super-heating degree of gas refrigerant at the outlet of the evaporator 4. Further, a heating device using a hot water as a heat source may be provided as the heating device for heating the liquid refrigerant stored in the gas-liquid separator 7, in place of the electric heater 35. In this case, a flow amount or a temperature of hot water is adjusted by an electric control valve, thereby adjusting the heating amount of the liquid refrigerant in the gas-liquid separator 7.

(Fifth Embodiment)

Figure 8:
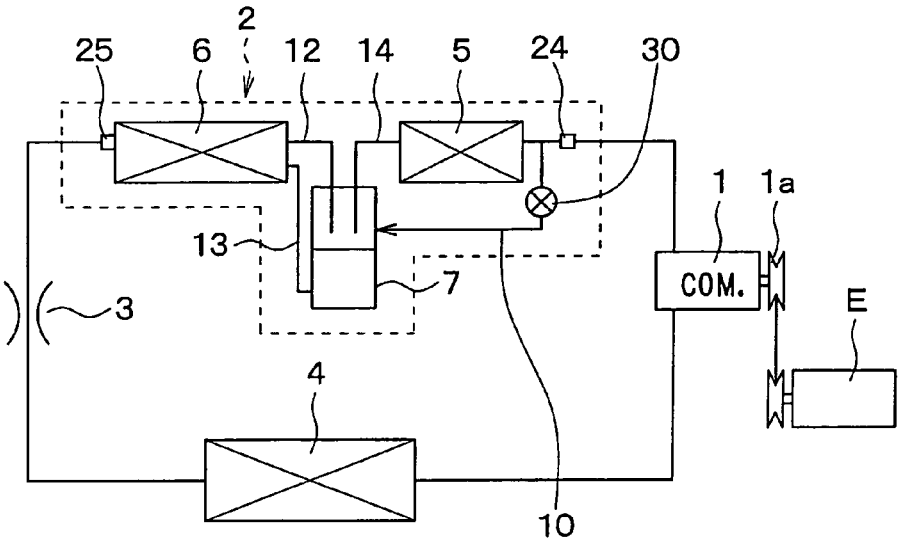
FIG. 8 is a schematic diagram showing a refrigerant cycle system according to a fifth embodiment of the present invention.

In the above-described first embodiment of the present invention, as shown in FIG. 1, an amount of the gas refrigerant to be introduced into the gas-liquid separator 7 is set by the gas refrigerant throttle 10*a*. However in the fifth embodiment, as shown in FIG. 8, a control valve 130 is provided in the gas-refrigerant bypass passage 10 in place of the gas refrigerant throttle 10*a*. Therefore, in the fifth embodiment, the flow amount ratio between the liquid refrigerant and the gas refrigerant to be introduced into the gas-liquid separator 7 can be accurately adjusted by adjusting the opening degree of the control valve 130.

Next, a specific construction of the separator-integrated condenser 2 according to the fifth embodiment will be described with reference to FIGS. 9 and 10. The condenser 2 includes the heat-exchanging portion 8 constructed with plural flat tubes 15 horizontally extending, and corrugated fins 16 connected to the plural flat tubes 15. The first and second heat-exchanging portions 5, 6 are integrally connected to form the heat-exchanging portion 8. The right header tank 18 has the same structure as that in the above-described first embodiment.

On the other hand, a left header tank 117 of the condenser 2 is integrally brazed to a gas-liquid separator 7. An inner space of the left header tank 117 is partitioned by two partition plates 119*a*, 119*b* into upper, intermediate and lower spaces 117*a*, 117*b*, 117*c*. The lower partition plate 119*b* in the header tank 117 and the partition plate 20 in the header tank 18 are arranged at the same height position in an up-down direction of the header tanks 117, 18. The first heat-exchanging portion 5 is arranged in an upper side area of the heat-exchanging portion 8, specifically, at an upper portion of both the partition plates 119*b*, 20. The second heat-exchanging portion 6 is arranged in a lower side area of the heat-exchanging portion 8, specifically, at a lower portion of both the partition plates 119*b*, 20.

The inlet joint 24 used as a refrigerant inlet is connected to the left header tank 117 at a portion corresponding to the intermediate space 117*b*. The inlet joint 24 is connected to a refrigerant discharge side pipe of the compressor 1. An upper connection joint 117*d* is connected to a side wall surface of the header tank 117 at an upper area corresponding to the upper space 117*a* and an upper portion of the intermediate space 117*b*, and a lower connection joint 117*e* is connected to the header tank 117 at a position around the lower end.

Figure 10:
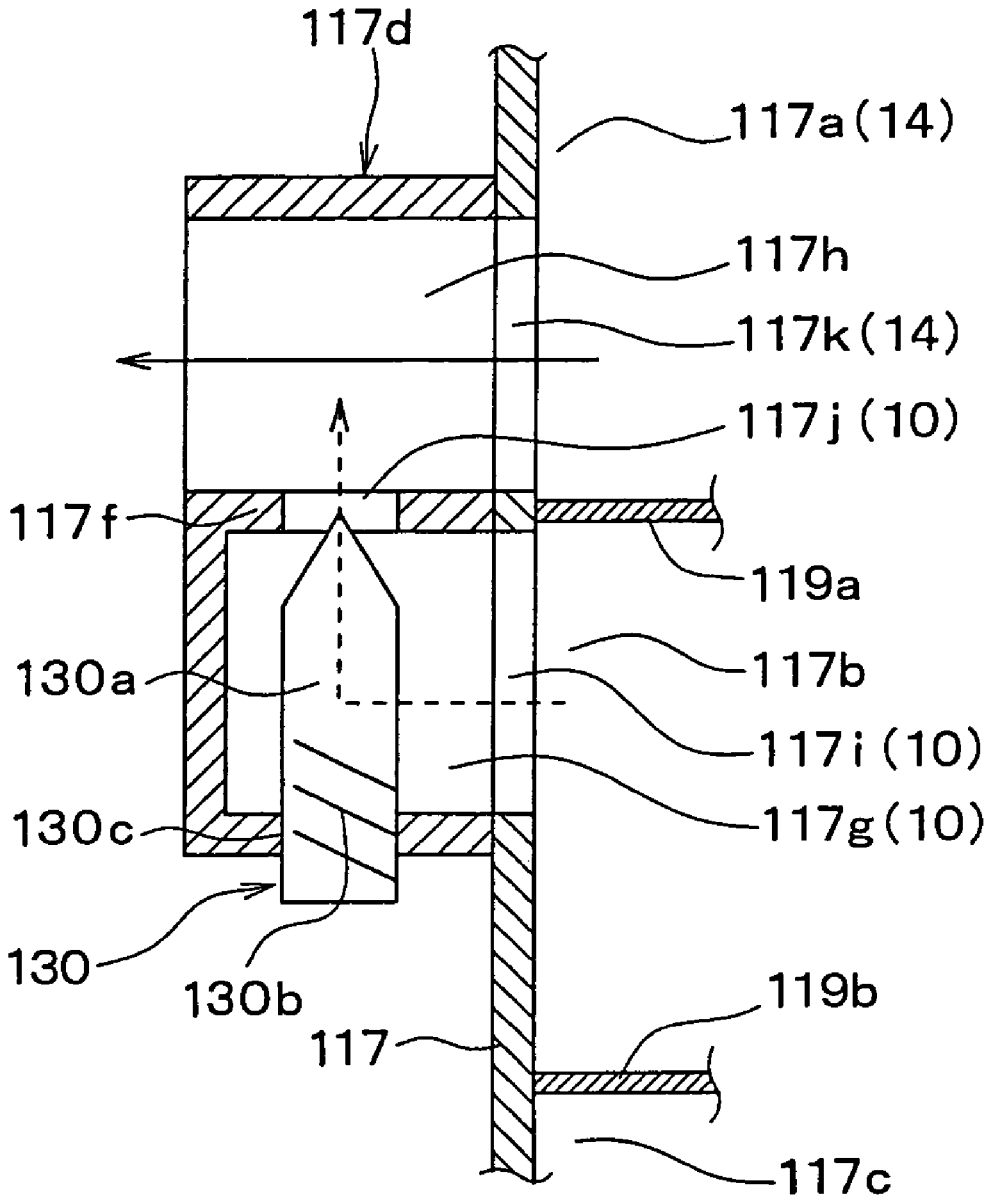
FIG. 10 is an enlarged sectional view showing a main part of the separator-integrated condenser shown in FIG. 9.

FIG. 10 is an enlarged view of the upper connection joint 117*d*. An intermediate partition wall 117*f* is provided in the upper connection joint 117*d*, so that refrigerant passages 117*g*, 117*h* are formed in the upper connection joint 117*d* above and below the intermediate partition wall 117*f*. The lower refrigerant passage 117*g* of the upper connection joint 117*d* communicates with the intermediate space 117*b* of the left header tank 117 through a first communication hole 117*i* provided in a side wall of the left header tank 117.

Accordingly, gas refrigerant, discharged from the compressor 1, flows from the inlet joint 24 into the intermediate space 117*b*. Then, a part of the gas refrigerant flows from the intermediate space 117*b* directly into the lower refrigerant passage 117*g* through the first communication hole 117*i*. Then, the gas refrigerant flows into the upper refrigerant passage 117*h* through a throttle hole 117*j* provided in the intermediate partition wall 117*f*. In this way, as shown in FIGS. 9, 10, the gas-refrigerant bypass passage 10 is constructed with the first communication hole 117*i*, the lower refrigerant passage 117*g* and the throttle hole 117*j*.

The other part of gas refrigerant flowing into the intermediate space 117*b* from the inlet joint 24 passes through the flat tubes 15 of the lower area of the first heat-exchanging portion 5, the upper space 18*a* of the header tank 18, and the flat tubes 15 of the upper area of the first heat-exchanging portion 5 to be cooled and condensed. The condensed refrigerant flows into the upper space 117*a* of the header tank 117.

The upper refrigerant passage 117*h* communicates with the upper space 117*a* of the left header tank 117 through a second communication hole 117*k* provided in the side wall of the left header tank 117. Therefore, the condensed refrigerant (liquid refrigerant) flowing into the upper space 117*a* of the left header tank 117 flows into the upper refrigerant passage 117*h* through the second communication hole 117*k*. In this way, the liquid-refrigerant introduction passage 14 is constructed with the upper space 117*a* and the second communication hole 117*k*. Both of the gas refrigerant from the throttle hole 117*j* and the liquid refrigerant from the second communication hole 117*k* flow into the upper refrigerant passage 117*h* of the upper connection joint 17*d*, and are mixed therein. That is, in the fifth embodiment, the gas-liquid mixing portion is constructed with the upper refrigerant passage 117*h* of the upper connection joint 117*d*.

The throttle hole 117*j* is a circular hole, and forms a smallest passage area in the gas-refrigerant bypass passage 10, thereby regulating and setting a gas-refrigerant bypass amount. A valve body 130*a*, movable in a hole-penetrating direction of the throttle hole 117*j*, is provided in the upper connection joint 117*d*. The valve body 130*a* has a circular-cone top end portion that is opposite to the throttle hole 117*j*, and a male screw portion 130*b*. The male screw portion 130*b* is provided to be engaged with a female screw portion 130*c* formed in a lower wall surface of the upper connection joint 117*d*. Therefore, the circular-cone top end portion of the valve body 130*a* can be inserted into and drawn out from the throttle hole 117*j* by using a suitable tool. The control valve 130 is constructed with the valve body 130*a*, the male screw portion 130*b* and the female screw portion 130*c*.

Figure 9:
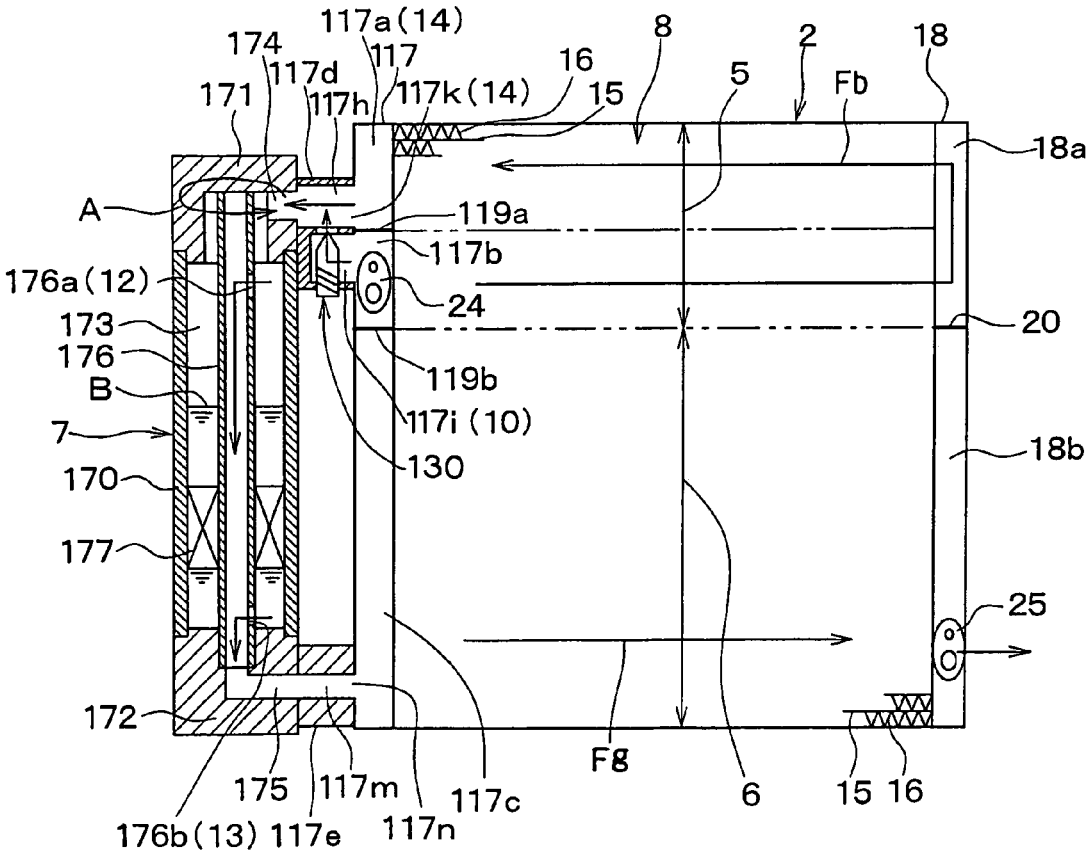
FIG. 9 a schematic sectional view showing a separator-integrated condenser with a gas-liquid separator according to the fifth embodiment.

As shown in FIG. 9, the gas-liquid separator 7 includes a cylindrical tank body 170 longitudinally extending in the up-down direction, and upper and lower covers 171, 172. The upper and lower covers 171, 172 close upper and lower open ends of the tank body 170, respectively. The members 170, 171, 172 are connected integrally with each other, thereby forming therein a space 173 where refrigerant is separated into gas refrigerant and liquid refrigerant.

The upper and lower covers 171, 172 are disposed opposite to the upper and lower connection joints 117*d*, 117*e*, and are fixed to the upper and lower connection joints 117*d*, 117*e* by screw members such as blots (not shown), respectively. The upper cover 171 has a refrigerant inlet passage 174 therein, and the upper passage (gas-liquid mixing portion) 117*h* of the upper connection joint 17*d* communicates with an upper portion of the inner space 173 through the refrigerant inlet passage 174. The lower cover 172 has a refrigerant outlet passage 175 therein, and the refrigerant outlet passage 175 communicates with the lower space 117*c* of the left header tank 117 through a refrigerant passage 117*m* of the lower connection joint 117*e* and a third communication hole 117*n* provided in the side wall of the left header tank 117.

Thus, the gas-liquid separator 7 is integrated to the side wall of the left header tank 117 through the upper and lower connection joints 117*d*, 117*e*. At this time, the refrigerant inlet passage 174 and the refrigerant outlet passage 175 of the gas-liquid separator 7 communicate with the upper and lower spaces 117*a*, 117*b* of the header tank 117, respectively. Here, an elastic seal member (not shown) such as an O-ring is disposed between the refrigerant inlet passage 174 and the upper connection joint 117*d*, and an elastic seal member is disposed between the refrigerant outlet passage 175 and the lower connection joint 117*e*. Therefore, sealing performance can be ensured between the refrigerant inlet passage 174 and the upper connection joint 117*d*, and between the refrigerant outlet passage 175 and the lower connection joint 117*e*.

Further, the refrigerant inlet passage 174 is disposed so as to be offset from a circular center of the circular inner space 173 of the gas-liquid separator 7. Therefore, as shown in FIG. 9, the turn flow A of refrigerant is formed in an upper inner area of the circular inner space 173. Further, a desiccant 177 for removing water contained in the refrigerant is disposed in the circular inner space 173 of the gas-liquid separator 7.

Thus, the refrigerant, flowing from the refrigerant inlet passage 174 into the gas-liquid separator 7, is forced to be separated into liquid refrigerant and gas refrigerant, by using the centrifugal force of the turn flow A. Therefore, even if the gas-liquid separator 7 has only a small tank capacity, the refrigerant flowing into the gas-liquid separator 7 can be surely separated into liquid refrigerant and gas refrigerant. Accordingly, a centrifugal separator is constructed at an upper portion of the inner space 173 of the gas-liquid separator 7 around the refrigerant inlet passage 175.

A circular pipe member 176 is disposed at a circular center area of the circular inner space 173 of the gas-liquid separator 7 so as to extend in the up-down direction. The top end of the pipe member 176 is supported in and is fixed to the upper cover 171, the bottom end of the pipe member 176 is inserted into an upper end opening of the refrigerant outlet passage 175 of the lower cover 172 to be supported in and fixed to the lower cover 172.

The pipe member 176 has a gas return opening 176*a* from which gas refrigerant is sucked. The gas return opening 176*a* is provided in an outer peripheral surface of the pipe member 176 at a position much higher than the liquid surface B of the liquid refrigerant. The gas refrigerant flows downward in an inner passage of the pipe member 176. Therefore, the gas-refrigerant return passage 12 is constructed with the gas return opening 176*a* and the like.

Further, the pipe member 176 has a liquid return opening 176*b*, from which liquid refrigerant is sucked. The liquid return opening 176*b* is provided in the outer peripheral surface of the pipe member 176 at a position much lower than the liquid surface B of the liquid refrigerant. The liquid refrigerant is sucked into the inner passage of the pipe member 176, and is mixed with the gas refrigerant sucked therein to be introduced into the refrigerant outlet passage 175. Therefore, the liquid-refrigerant return passage 13 is constructed with the liquid return opening 176*b* and the like.

Refrigerant from the refrigerant outlet passage 175 of the gas-liquid separator 7 flows into the lower space 117*c* of the header tank 117 through the refrigerant passage 117*m* of the lower connection joint 117*e* and the third communication hole 117*n* of the header tank 117, and is further heat-exchanged with outside air in the flat tubes 15 of the second heat-exchanging portion 6 to be super-cooled. Thereafter, the super-cooled refrigerant flows into the lower space 18*b* of the header tank 18, and flows toward the decompression device 3 through the outlet joint 25.

All of the flat tubes 15 of the heat-exchanging portion 8 (first and second heat-exchanging portions 5, 6), the corrugated fins 16, the header tanks 117, 18, the connection joints 117*d*, 117*e*, the inlet joint 24, the outlet joint 25 and the like are made of aluminum, and are integrated together by brazing.

Next, operation of the fifth embodiment will be now described. Gas refrigerant is discharged from the compressor 1, and flows from the inlet joint 24 into the intermediate space 117*b* of the left header tank 117. Then, the refrigerant flowing into the intermediate space 117*b* of the header tank 117 is branched into a refrigerant flow toward the first heat-exchanging portion 5 and a refrigerant flow toward the upper connection joint 117*d* while bypassing the first heat-exchanging portion 5.

Therefore, a part of the gas refrigerant discharged from the compressor 1 passes through the first heat-exchanging portion 5, and is U-turned in the upper space 18*a* of the header tank 18, as shown by the arrow Fb in FIG. 9. In a normal cycle operation condition, the gas refrigerant discharged from the compressor 1 radiates heat to outside air, and is condensed while flowing in a U-turn refrigerant passage of the first heat-exchanging portion 5. Therefore, the condensed refrigerant (liquid refrigerant) flows into the upper space 117*a* of the left header tank 117, and flows into the upper refrigerant passage 117*h* of the upper connection joint 117*d* through the second communication hole 117*k*.

On the other hand, the other part of the discharged gas refrigerant flows from the intermediate space 117*b* directly into the upper refrigerant passage 117*h* through the first communication hole 117*i*, the lower refrigerant passage 117*g* and the throttle hole 117*j*. Therefore, all of the condensed refrigerant (liquid refrigerant) after passing through the first heat-exchanging portion 5 and the gas refrigerant from the throttle hole 117*j* are mixed in the upper refrigerant passage 117*h*. Then, the mixed refrigerant flows into the refrigerant inlet passage 174 of the gas-liquid separator 7, and is introduced into the upper portion of the circular inner space 173. The mixed refrigerant flows in the upper portion of the circular inner space 173 in the turn flow A, and is separated into gas refrigerant and liquid refrigerant by using the centrifugal force of the turn flow A. The liquid refrigerant drops downwardly to be stored in the gas-liquid separator 7 at the lower side.

A part of liquid refrigerant in the gas-liquid separator 7 flows into the inner space of the pipe member 176 through the liquid return opening 176*b*. Simultaneously, gas refrigerant in the upper portion of the gas-liquid separator 7 flows into the inner space of the pipe member 176 through the gas return opening 176*a*. Generally, the opening area of the liquid return opening 176*b* is set greatly smaller than the opening area of the gas return opening 176*a*, so that the amount of the liquid refrigerant flowing into the liquid return opening 176*b* is set at a very small amount.

The gas refrigerant and the liquid refrigerant, flowing into the pipe member 176 through the gas return opening 176*a* and the liquid return opening 176*b*, is introduced into the lower space 117*c* of the left header tank 117 through the refrigerant outlet passage 175, the refrigerant passage 117*m* of the lower connection joint 117*e* and the third communication hole 117*n* of the left header tank 117 in this order.

The gas refrigerant and the liquid refrigerant are mixed in the refrigerant passages, and pass through the flat tubes 15 in the second heat-exchanging portion 6 as indicated by the arrow Fg in FIG. 9. While the refrigerant passes through the flat tubes 15 in the second heat-exchanging portion 6, the refrigerant further radiates heat to outside air to be super-cooled, and flows into the lower space 18*b* of the right header tank 18. Thereafter, the super-cooled refrigerant flows outside of the condenser 2 from the outlet joint 25, and flows toward the decompression device 3.

In the fifth embodiment, a part of the liquid refrigerant, stored in the gas-liquid separator 7, is always introduced into the second heat-exchanging portion 6 through the liquid return opening 176*b*, and is circulated into the refrigerant cycle. Therefore, lubricating oil contained in liquid refrigerant is surely returned into the compressor 1, thereby improving lubricating performance of the compressor 1.

In order to form the above-described refrigerant flow, all of the condensed refrigerant (liquid refrigerant) after passing through the first heat-exchanging portion 5 and the part of the discharged gas refrigerant flowing from the inlet joint 24 into the left header tank 17 are mixed and heat-exchanged with each other in the upper refrigerant passage 117*h* of the upper connection joint 117*d*. In this way, the refrigerant, flowing from the upper refrigerant passage 117*h* into the gas-liquid separator 7, is in the gas-liquid two-phase state having a dry degree corresponding to a super-heating degree of the discharged gas refrigerant of the compressor 1.

As a result, the amount of liquid refrigerant stored in the gas-liquid separator 7 is an amount corresponding to the super-heating degree of the gas refrigerant discharged from the compressor 1. That is, the amount of liquid refrigerant stored in the gas-liquid separator 7 can be adjusted in accordance the change of the super-heating degree of the gas refrigerant discharged from the compressor 1. An amount of the gas refrigerant, introduced from the gas-liquid separator 7 into the second heat-exchanging portion 6, is changed by adjusting this liquid refrigerant amount stored in the gas-liquid separator 7, thereby adjusting an amount of refrigerant circulated in the refrigerant cycle and adjusting the super-heating degree of the gas refrigerant discharged from the compressor 1. Since the compression of the compressor 1 is performed with an isentropic change basically, if the super-heating degree of the gas refrigerant discharged from the compressor 1 can be controlled, the super-heating degree of the gas refrigerant at an outlet of the evaporator 4 can be also controlled.

In the refrigerant cycle system of the fifth embodiment, the refrigerant circulation amount is adjusted by adjusting the amount of liquid refrigerant staying in the gas-liquid separator 7. Specifically, a flow ratio between the gas refrigerant directly introduced into the gas-liquid separator 7 through the gas-refrigerant bypass passage 10 and the liquid refrigerant introduced from the liquid refrigerant introduction passage 14 into the gas-liquid separator 7 is controlled to a set ratio, so that the refrigerant circulation amount in the refrigerant cycle and the super-heating degree of the gas refrigerant discharged from the compressor 1 can be controlled.

Figure 11:
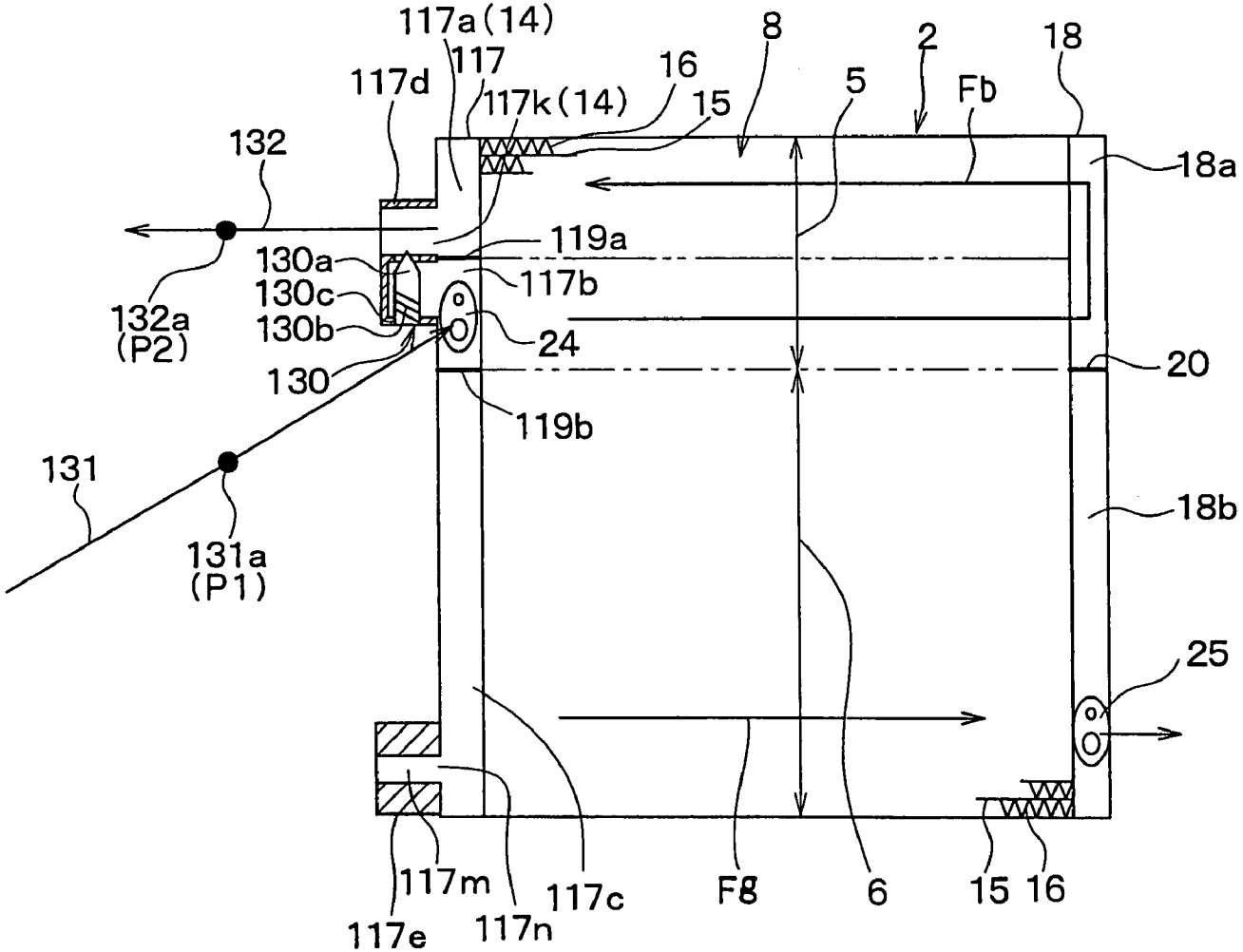
FIG. 11 is a schematic sectional view showing a single condenser portion and a detecting method of a pressure loss in a refrigerant passage of a first heat-exchanging portion of the condenser, according to the fifth embodiment.

Next, adjusting operation of the control valve 130 will be described. FIG. 11 shows a single condenser portion of the condenser 2 after a brazing process is finished, before being assumed with the gas-liquid separator 7. In this state of the condenser 2 shown in FIG. 11, a pressure loss in the refrigerant passage of the first heat-exchanging portion 5 is detected. When the pressure loss is detected, the valve body 130*a* of the control valve 130 is rotated by the suitable tool to be positioned at an entirely closed position of the throttle hole 117*j*. In this state, pressure detecting pipes 131, 132 are connected to the inlet joint 24 and the upper refrigerant passage 117*h* of the upper connection joint 117*d*, respectively. An inlet pressured detecting point 131*a* and an outlet pressure detecting point 132*a* are set in the pressure detecting pipes 131, 132, respectively.

A fluid compressor (not shown) for supplying a predetermined pressure fluid into the pressure detecting pipe 131, specifically, an air compressor is connected to an inlet side of the pressure detecting pipe 131. An outlet side of the pressure detecting pipe 132 is opened to the atmospheric air. Predetermined-pressure air is supplied from the air compressor into the refrigerant passage of the first heat-exchanging portion 5, and pressure P1 at the inlet pressure detecting point 131*a* and pressure P2 at the outlet pressure detecting point 132*a* are detected. Pressure loss ΔP (P1–P2) is calculated based on detected pressure P1 and detected pressure P2. The pressure loss ΔP is a value showing an affecting degree of dimension differences in manufacturing and due to solder invasion in the condenser 2. Here, a passage area of the throttle hole 117*j*, required to maintain the ratio between the gas refrigerant bypass amount and the liquid refrigerant amount at a predetermined set ratio, is calculated beforehand. That is, a relationship between a predetermined set position of the valve body 130*a* of the control valve 130 and the pressure loss ΔP is calculated beforehand. Here, the predetermined set position is a rotation angle position from the entirely closed position of the valve body 130*a*.

In this way, the valve body 130*a* of the control valve 130 is rotated to a set rotation angle position corresponding to the pressure loss ΔP, by a rotation angle from the entirely closed position. Therefore, the passage area of the throttle hole 117*j* can be suitably set in consideration of the dimension difference in the manufacturing, the solder invasion and the like. Thus, the ratio between the gas refrigerant bypass amount and the liquid refrigerant amount introduced into the gas-liquid separator 7 can be maintained at a predetermined set ratio, thereby suitably controlling the super-heating degree of refrigerant discharged from the compressor 1. After the rotation position of the valve body 130*a* is set, the valve body 130*a* is fixed to the upper connection joint 117*d* so that its set rotation position is not changed.

(Sixth Embodiment)

Figure 12:
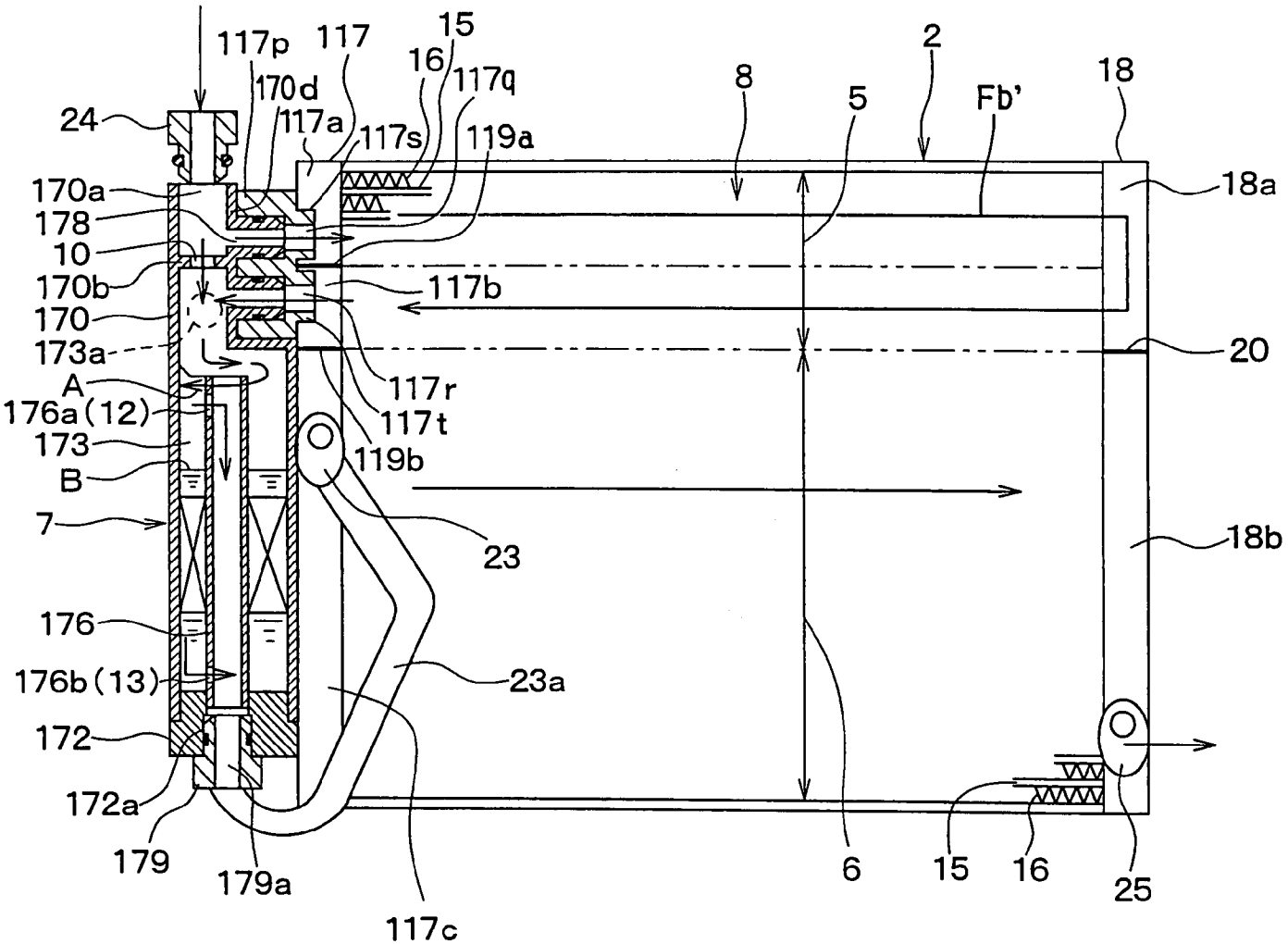
FIG. 12 is a schematic sectional view showing a separator-integrated condenser with a gas-liquid separator according to a sixth embodiment of the present invention.
Figure 13:
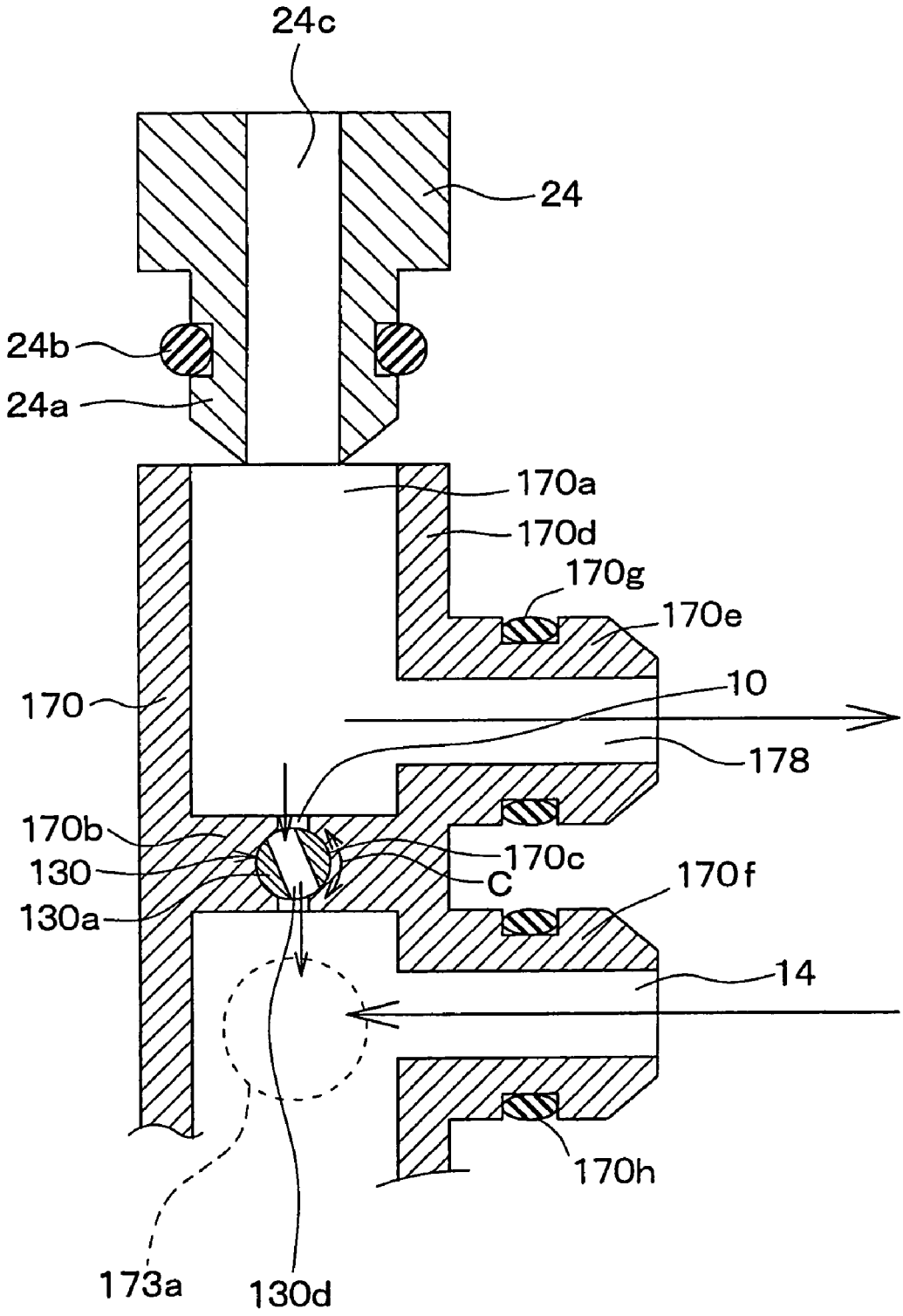
FIG. 13 is an enlarged sectional view showing a main part of the separator-integrated condenser shown in FIG. 12.

In the above-described fifth embodiment, the inlet joint 24, the gas-refrigerant bypass passage 10 (the first communication hole 117*i*, the lower refrigerant passage 117*g* and the throttle hole 117*j*) and the control valve 130 are provided in the condenser 2. However, in the sixth embodiment, the inlet joint 24, the gas-refrigerant bypass passage 10 and the control valve 130 are provided in the gas-liquid separator 7, as shown in FIGS. 12, 13. In the sixth embodiment, the parts similar to those of the above-described fifth embodiment are indicated by the same reference numbers, and detail description thereof is omitted.

In the gas-liquid separator 7, the tank body 170 has a circular upper opening 170*a* at its upper wall portion, and a cylindrical projection 24*a* of the inlet joint 24 is fitted into the upper opening 170*a* of the tank body 170. An O-ring 24*b* as an elastic seal member is attached to an outer peripheral ditch of the cylindrical projection 24*a*, so that the clearance between the cylindrical projection 24*a* and an inner peripheral surface of the upper opening 170*a* is air-tightly sealed. The inlet joint 24 is fixed to the upper wall portion of the tank body 170 by using bolts (not shown). The inlet joint 24 has a through passage hole 24*c* provided in an axial direction of the cylindrical projection 24*a* (in the up-down direction), and gas refrigerant discharged from the compressor 1 is circulated into an inner space of the upper opening 170*a* through the passage hole 24*c*.

A ring plate portion 170*b* protruding to an inner space of the upper opening 170*a* is formed at a position lower than a top end surface of the upper opening 170*a* by a predetermined dimension. The ring plate portion 170*b* has a through hole at its center area, so as to form the gas-refrigerant bypass passage 10. The gas refrigerant discharged from the compressor 1 flows into the upper opening 170*a*. A part of the gas refrigerant flowing into the upper opening 170*a* is directly introduced into the circular inner space (gas-liquid separating space) 173 through the gas-refrigerant bypass passage 10. The amount of gas refrigerant introduced into the circular inner space 173 is restricted by a passage area (hole opening area) of the gas-refrigerant bypass passage 10.

As shown in FIG. 13, the control valve 130 is disposed in the gas-refrigerant bypass passage 10. The control valve 130 include the valve body 130*a* having a rotary structure, and the valve body 130*a* has a through hole 130*d* provided in its radial direction. The ring plate portion 170*b* has a circular joint hole 170*c* extending in a direction perpendicular to the refrigerant flow direction (up-down direction) of the gas-refrigerant bypass passage 10. The circular valve body 130*a* is fitted in the circular joint hole 170*c* to be rotatable in a direction indicated by C in FIG. 13. A rotation shaft (not shown) is integrated to an end of the valve body 130*a* in its axial direction (in a perpendicular direction of the paper surface of FIG. 13), and is projected outside of the tank body 170. The valve body 130*a* is rotated by operation from an outside of the tank body 170 through the rotation shaft. An elastic seal member such as an O-ring is disposed between the joint hole portion of the tank body 170 and the rotation shaft to seal therebetween.

Cylindrical projections 170*e*, 170*f* are integrated to an upper sidewall 170*d* of the tank body 170 at upper and lower sides (upstream and downstream sides) of the gas-refrigerant bypass passage 10, respectively. The upper cylindrical projection 170*e* has therein a through hole for defining a gas-refrigerant condensing passage 178. The gas refrigerant flowing into the upper opening 170*a* is distributed into the gas-refrigerant condensing passage 178 and the gas-refrigerant bypass passage 10. In the sixth embodiment, an amount of gas refrigerant distributed into the gas-refrigerant bypass passage 10 is set larger than that distributed into the gas-refrigerant condensing passage 178.

The lower cylindrical projection 170*f* also has therein a through hole for defining the liquid-refrigerant introduction passage 14. All of refrigerant (liquid refrigerant) condensed in the first heat-exchanging portion 5 of the condenser 2 is introduced into a gas-liquid mixing area 173*a* through the liquid-refrigerant introduction passage 14. The gas-liquid mixing area 173*a* is located directly below the gas-refrigerant bypass passage 10 in the inner space 173 of the tank body 170. The gas-liquid mixing area 173*a* corresponds to the upper refrigerant passage 117*h* for forming the gas-liquid mixing portion in the fifth embodiment. O-rings 170*g*, 170*h* as elastic seal members are attached to outer circumferential ditches of both cylindrical projections 170*e*, 170*f*, respectively.

A connection joint 117*p* is made of metal such as aluminum, and is brazed to the left header tank 117 of the condenser 2. The connection joint 117*p* has circular passage holes 117*q*, 117*r*. The cylindrical projections 170*e*, 170*f* of the tank body 170 are fitted in the circular passage holes 117*q*, 117*r*. The O-ring 170*g* is provided to seal the clearance between the passage hole 117*q* of the connection joint 117*p* and the cylindrical projection 170*e*, and the O-ring 170*h* is provided to seal the clearance between the passage hole 117*r* and the cylindrical projection 170*f*. The tank body 170 is fixed to the connection joint 117*p* by bolts (not shown). The connection joint 117*p* includes cylindrical joint projections 117*s*, 117*t* corresponding to the refrigerant holes 117*q*, 117*r*, respectively, in the left header tank 117. The connection joint 117*p* is connected to the left header tank 117 while joint projections 117*s*, 117*t* are fitted in joint holes of the left header tank 117.

In this way, the upper space 117*a* of the left header tank 117 communicates with the gas-refrigerant condensing passage 178 of the gas-liquid separator 7 through the upper passage hole 117*q* of the connection joint 117*p*. The intermediate space 117*b* of the left header tank 117 communicates with the liquid-refrigerant introduction passage 14 of the gas-liquid separator 7 through the lower passage hole 117*r* of the connection joint 117*p*. Accordingly, a part of the gas refrigerant introduced into the upper opening 170*a* of the gas-liquid separator 7 flows from the upper passage hole 117*q* into the upper space 117*a* of the left header tank 117 through the gas-refrigerant condensing passage 178. Further, the condensed refrigerant (liquid refrigerant) in the intermediate space 117*b* of the left header tank 117 is circulated into the gas-liquid mixing area 173*a* through the lower passage hole 117*r* and the liquid-refrigerant introduction passage 14. That is, the refrigerant is U-turned in the first heat-exchanging portion 5 as indicated by the arrow Fb' in FIG. 12.

A return inlet joint 23, for forming an inlet of refrigerant returned from the gas-liquid separator 7, is connected to the left header tank 117 at a position corresponding to the lower space 117*c*. The return inlet joint 23 is connected to a bottom connection joint 179 of the gas-liquid separator 7 through a connection pipe 23*a*. The connection joint 179 is liquid-tightly fixed into a center hole 172*a* provided in the lower cover 172 through an O-ring as an elastic seal member. The center hole 172*a* corresponds to the refrigerant outlet passage in the fifth embodiment. On the other hand, a lower end of the pipe member 176 is fixed into and supported by the center hole 172*a* of the lower cover 172. In this way, the lower end of the inner passage of the pipe member 176 communicates with a passage hole 179*a* of the connection joint 179. The upper end of the pipe member 176 is located much higher than the liquid surface B of the liquid refrigerant stored in the gas-liquid separator 7.

The mixed refrigerant in the gas-liquid mixing area 173*a* is separated into gas refrigerant and liquid refrigerant by using the centrifugal force of the turn flow A. The separated liquid refrigerant is stored in the inner space 173 of the gas-liquid separator 7 at the lower side, and the separated gas refrigerant is stored above the liquid refrigerant in the gas-liquid separator 7. The gas refrigerant and the liquid refrigerant in the gas-liquid separator 7 are introduced into the pipe member 176 from the gas return opening 176*a* and the liquid return opening 176*b*, respectively. Then, the gas refrigerant and the liquid refrigerant in the pipe member 176 flows into the lower space 117*c* of the left header tank 117 through the connection joint 179, the connection pipe 23*a* and the return inlet joint 23.

That is, in the sixth embodiment, the inlet joint 24 is disposed on the gas-liquid separator 7, and the distribution mechanism for distributing the discharged gas refrigerant into the gas-liquid separator 7 and the first heat-exchanging portion 5 is also disposed in the gas-liquid separator 7. Specifically, in the single state of the condenser 2 after a brazing process is finished before the gas-liquid separator 7 is attached to the condenser 2, as described in the fifth embodiment, the refrigerant pressure P1 at the inlet of the first heat-exchanging portion 5 and the refrigerant pressure P2 at the outlet thereof are detected. Then, the pressure loss ΔP (P1–P2) in the first heat-exchanging portion 5 is calculated based on detected pressure P1 and detected pressure P2. The set value (i.e., rotation amount from the entirely closed position) of the valve body 130*a* of the control valve 130 is determined based on the pressure loss ΔP, and the valve body 130*a* is rotated to the set value.

Therefore, the ratio between the gas-refrigerant bypass amount and the liquid refrigerant amount flowing into the gas-liquid separator 7 can be maintained at the predetermined ratio without being affected by the dimension variation in the manufacturing and the dimension difference due to the solder invasion and the like. Thus, the super-heating degree of refrigerant can be suitably controlled in the refrigerant cycle system. Further, in the first to fifth embodiments, since the gas-refrigerant bypass passage 10 is provided in the condenser 2 at the connection joint 117*d*, a solder (i.e., brazing material) may be invaded into the gas-refrigerant bypass passage 10 when the condenser 2 is integrally brazed. However, in the sixth embodiment, since the gas-refrigerant bypass passage 10 is provided in the gas-liquid separator 7, the brazing material is prevented from being invaded into the gas-refrigerant bypass passage 10 in the brazing of the condenser 2, and it can prevent the passage area of the gas-refrigerant bypass passage 10 from being reduced.

(Seventh Embodiment)

Figure 14:
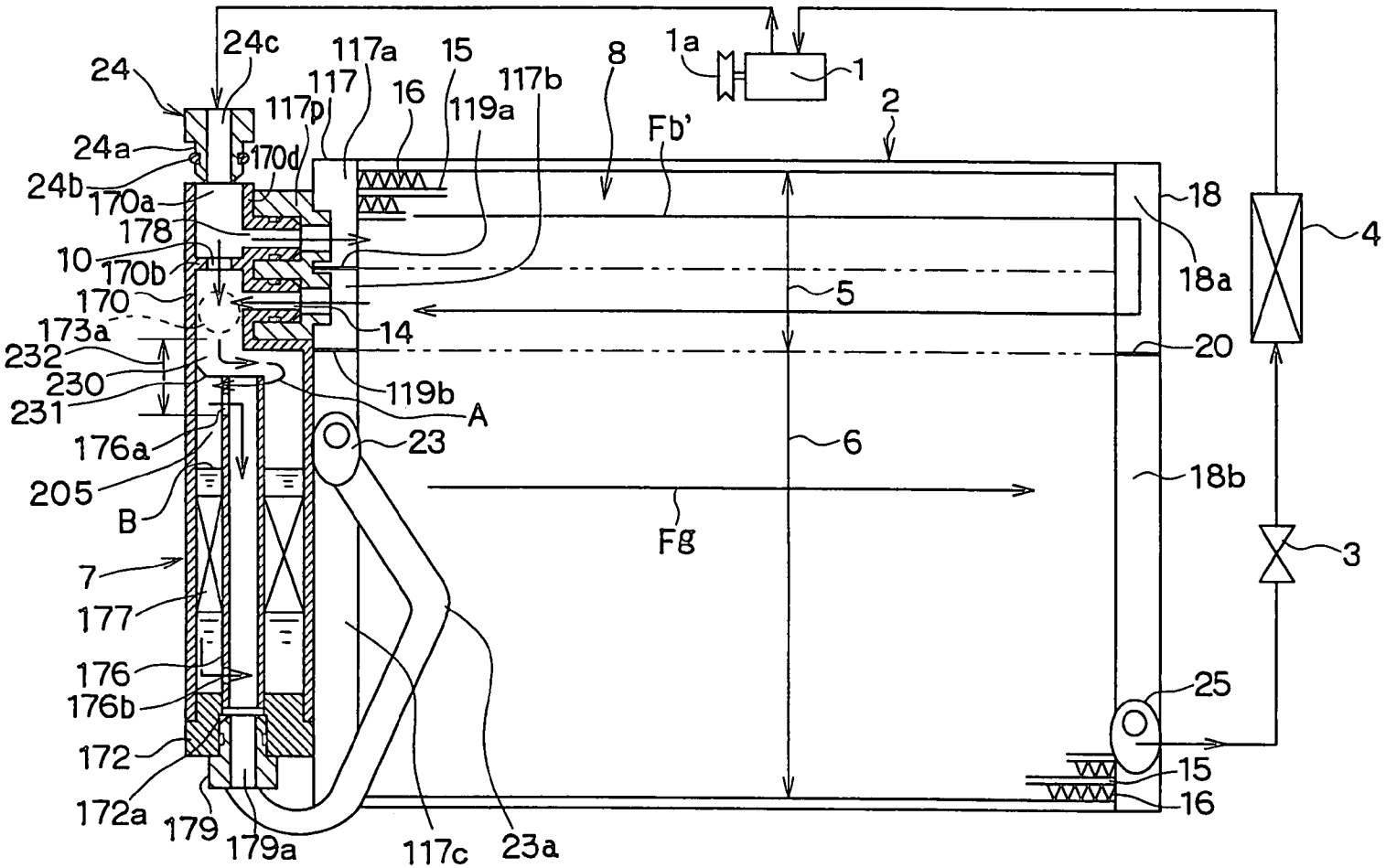
FIG. 14 is a schematic diagram showing a refrigerant cycle system having a separator-integrated condenser with a gas-liquid separator, according to a seventh embodiment of the present invention.
Figure 15:
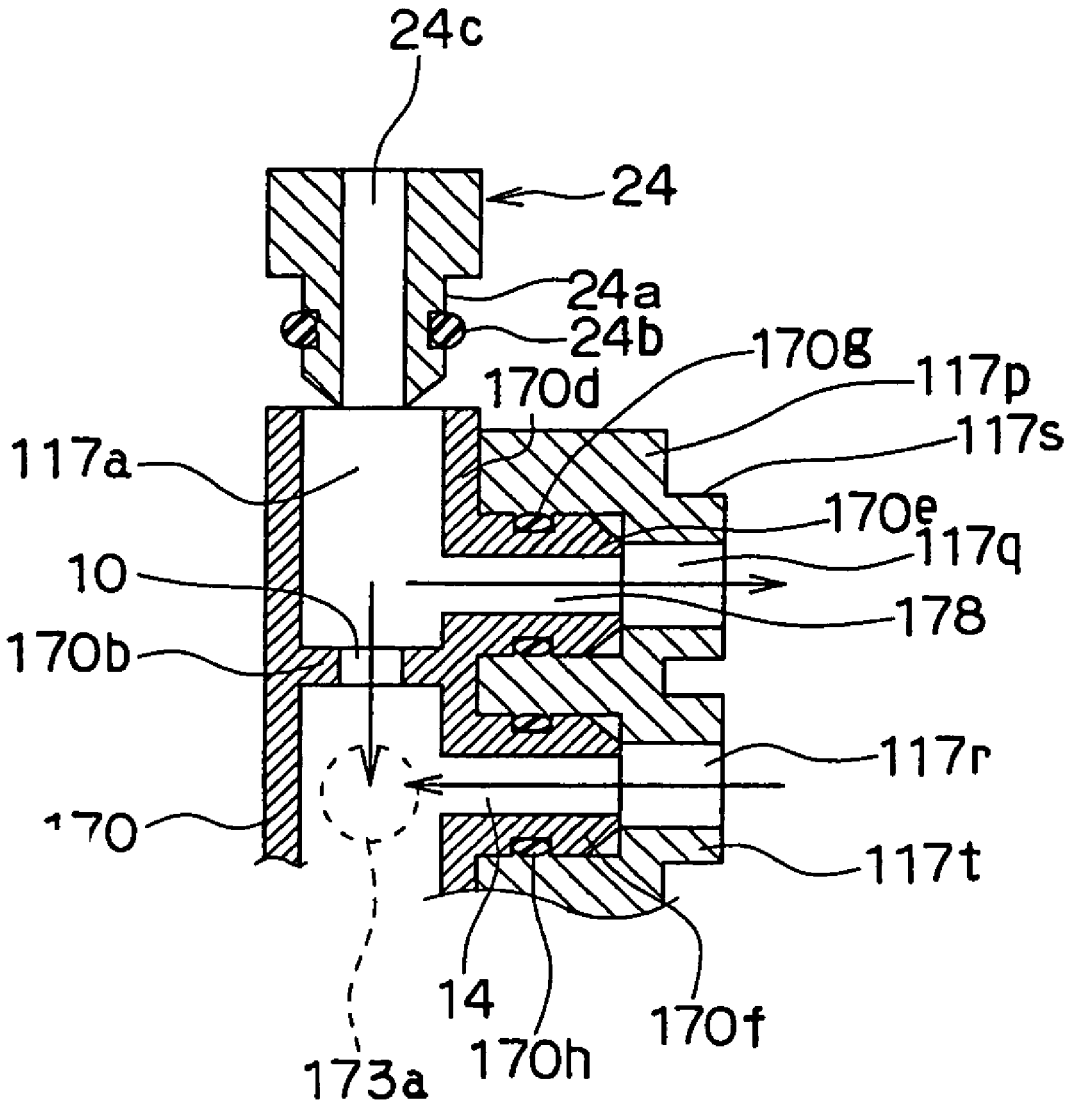
FIG. 15 is an enlarged sectional view showing a main part of the separator-integrated condenser shown in FIG. 14.

The seventh embodiment of the present invention will be now described with reference to FIGS. 14 and 15. In the seventh embodiment, the parts similar to those of the above-described fifth and sixth embodiments are indicated by the same reference numbers, and detail description thereof is omitted. As shown in FIGS. 14, 15, in the seventh embodiment, the valve body 130 of the sixth embodiment is not provided in the ring plate portion 170*b*. Specifically, the ring plate portion 170*b* has a very small hole for defining the gas-refrigerant bypass passage 10. The ring plate portion 170*b* can be integrated to the tank body 170 by die casting and the like, and the ring plate portion 170*b* is finely machined to provide the very small hole for forming the gas-refrigerant bypass passage 10.

A part of the gas refrigerant, flowing into the upper opening 170*a*, is introduced directly into a gas-liquid separating space 205 through the gas-refrigerant bypass passage (very small hole) 10. An amount of the gas refrigerant flowing into the gas-liquid separating space 205 is set by the passage area (opening area of the very small hole) of the gas-refrigerant bypass passage 10. Therefore, the distribution ratio of the gas refrigerant can be set by setting the passage area ratio between the gas-refrigerant bypass passage 10 and the gas-refrigerant condensing passage 178. In the seventh embodiment, the distribution amount of gas refrigerant into the gas-refrigerant bypass passage 10 is set larger than that into the gas-refrigerant condensing passage 178.

The tank body 170 of the gas-liquid separator 7 has a turn passage 230 in the gas-liquid separating space 205, and refrigerant flows downward along the turn flow A in the turn passage 230. A guide plate 231 is provided to prevent refrigerant from directly flowing downward from the gas-liquid mixing area 173*a* along the circular inner wall surface of the tank body 170. Because the guide plate 231 is provided, the generation performance of the turn flow A of refrigerant can be improved. Further, the components of the gas-liquid separator 7 such as the pipe member 176 and the desiccant 177 can be attached into and detached from the tank body 170 by removing the lower cover 172 from the tank body 170.

As in the sixth embodiment, a distribution passage structure, for distributing the gas refrigerant into the tank body 170 of the gas-liquid separator 7 and the first heat-exchanging portion 5, is disposed in the gas-liquid separator 7. Because the distribution passage structure is not required to be provided in the header tank 117 of the condenser 2, a refrigerant passage structure of the header tank 117 of the condenser 2 can be simplified, thereby reducing its production cost. Further, a passage area of the gas-refrigerant bypass passage 10 can be readily changed in the tank body 170 of the gas-liquid separator 7 without changing the structure of the condenser 2. Furthermore, as in the sixth embodiment, since the gas-refrigerant bypass passage 10 is provided in the tank body 70, the gas-refrigerant bypass passage 10 is not adversely affected due to the solder invasion when the condenser portion of the condenser 2 is brazed.

Since the gas-refrigerant bypass passage 10 can be visually examined directly from the upper opening 170*a* of the tank body 170, clogging abnormality of the gas-refrigerant bypass passage 10 can be readily found, thereby preventing a defective product from being delivered. Further, as in the first embodiment, the passage diameter of the gas-refrigerant bypass passage 10 can be increased to a relatively large diameter (e.g., Ø5.5 mm), thereby reducing the affecting degree of the dimension variations of the gas-refrigerant bypass passage 10 in the manufacturing.

(Eighth Embodiment)

Figure 16:
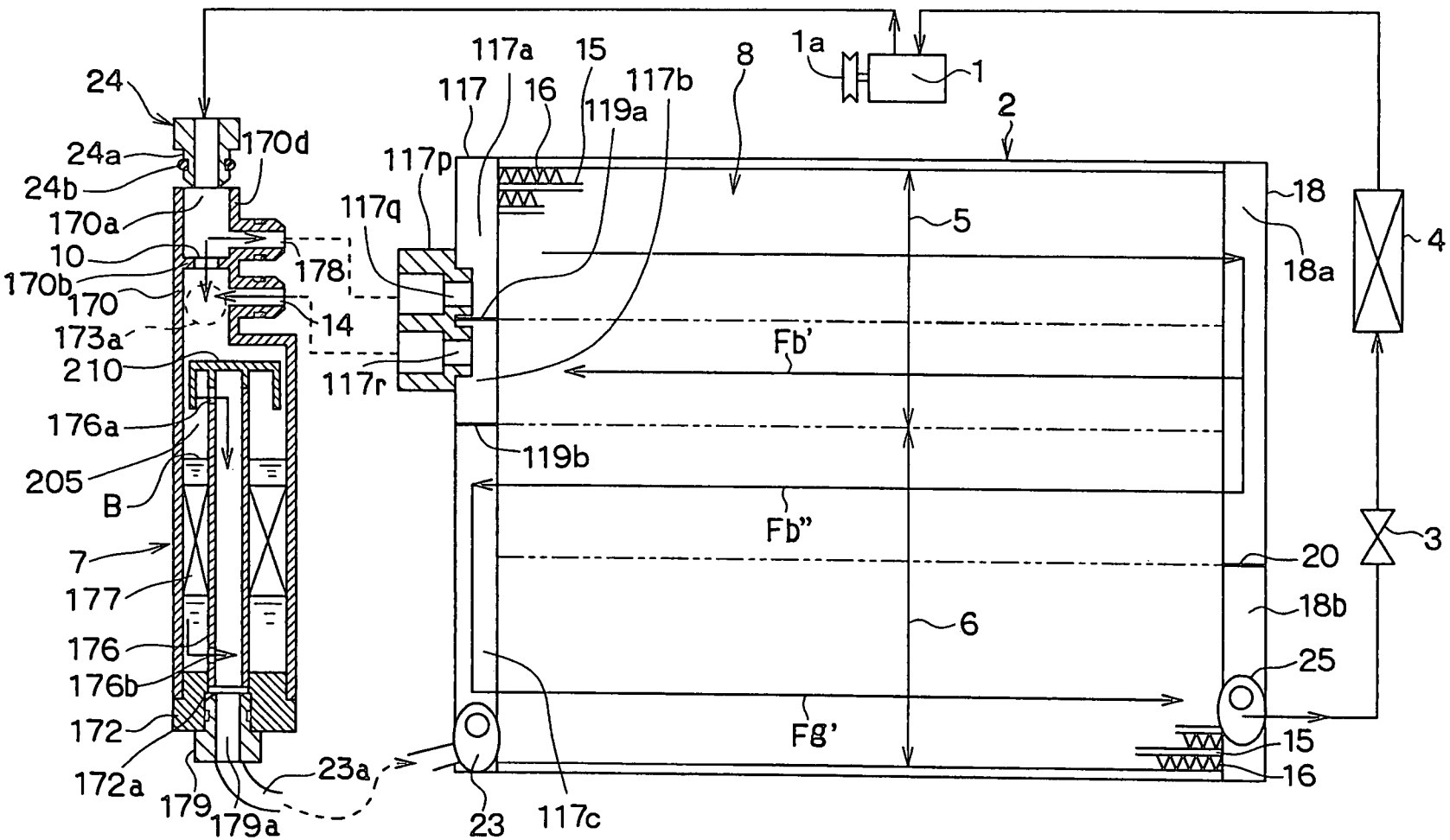
FIG. 16 is a schematic diagram showing a refrigerant cycle system having a separator-integrated condenser with a gas-liquid separator, according to an eighth embodiment of the present invention.

In the above-described first to seventh embodiments, all of the condensed refrigerant (liquid refrigerant) after passing through the first heat-exchanging portion 5 is introduced into the gas-liquid separator 7. However, in the eighth embodiment, a part of the condensed refrigerant after passing through the first heat-exchanging portion 5 is introduced into the gas-liquid separator 7, and the other part thereof is introduced directly into the second heat-exchanging portion 6. As shown in FIG. 16, the partition plate 20 is disposed in the right header tank 18 at a position lower than the arrangement position of the second partition plate 119*b* disposed in the left header tank 117.

Figure 6B:
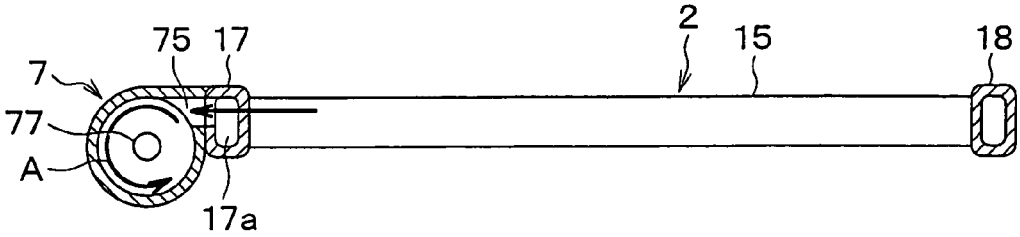
FIG. 6B is a schematic sectional view showing a refrigerant inlet portion of the gas-liquid separator in the separator-integrated condenser according to the third embodiment.

Therefore, in the eighth embodiment, a flow of the refrigerant after passing through the flat tubes 15 at the upper portion of the first heat-exchanging portion 5 is branched into two streams. Specifically, an about half of the refrigerant introduced into the upper space 117*a* of the left header tank 117 passes through the flat tubes 15 at a lower portion of the first heat-exchanging portion 5 as indicated by the arrow Fb' in FIG. 16, and is condensed therein. The condensed refrigerant (liquid refrigerant) flows into the gas-liquid separator 7 through the intermediate space 117*b* of the left header tank 117 and the connection joint 117*p*. On the other hand, the other part of the refrigerant introduced into the upper space 117*a* flows into the lower space 117*c* of the left header tank 117 as indicated by the arrow Fb" in FIG. 16 after passing through the flat tubes 15 in an upper area of the second heat-exchanging portion 6 upper than the partition wall 20. The liquid refrigerant flowing into the lower space 117*c* of the left header tank 117 as indicated by the arrow Fb" in FIG. 6 is mixed with refrigerant introduced from the return inlet joint 23 therein. The mixed refrigerant in the lower space 117*c* passes through the flat tubes 15 at the lower area of the second heat-exchanging portion 6 as indicated by the arrow Fg', and is super-cooled therein.

In the eighth embodiment, only a part of the refrigerant condensed in the first heat-exchanging portion 5 is introduced into the gas-liquid separator 7. Therefore, the gas refrigerant amount distributed from the gas-refrigerant condensing passage 178 into the first heat-exchanging portion 5 is set larger than the gas refrigerant amount distributed into the gas-liquid separator 7 through the gas-refrigerant bypass passage 10.

In the eighth embodiment, a cup-shaped guide plate 210 is disposed on an upper end of the pipe member 176 in place of the guide plate 231 described in the seventh embodiment, thereby increasing the gas-liquid separating performance. Liquid refrigerant drops from an outer peripheral portion of the guide plate 210, and only gas refrigerant stored in the inner space 205 at an upper side is sucked into the gas return opening 176*a* of the pipe member 176. In the eighth embodiment, the other parts are similar to those of the above-described seventh embodiment.

(Ninth Embodiment)

Figure 17:
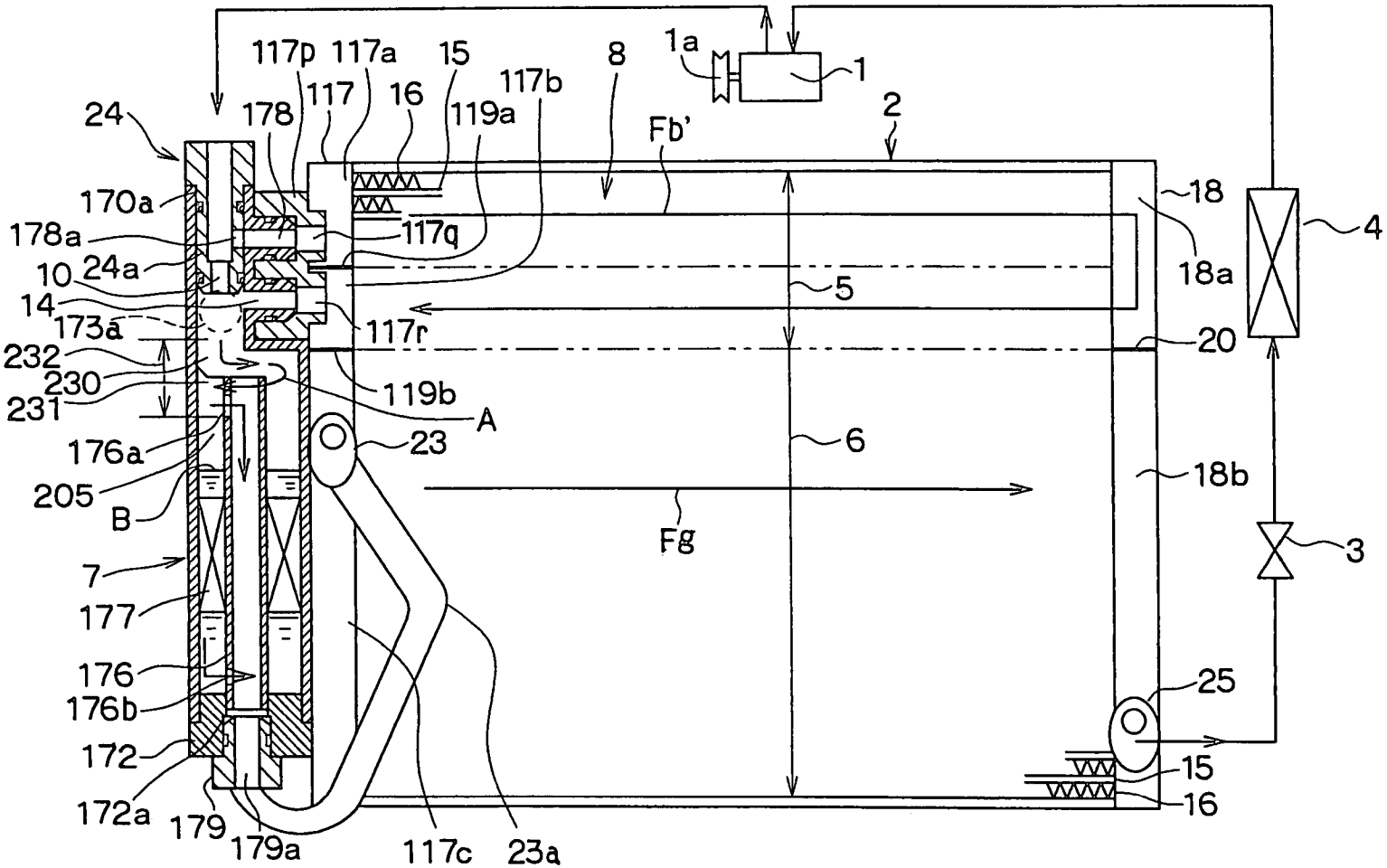
FIG. 17 a schematic diagram showing a refrigerant cycle system having a separator-integrated condenser with a gas-liquid separator, according to a ninth embodiment of the present invention.
Figure 18:
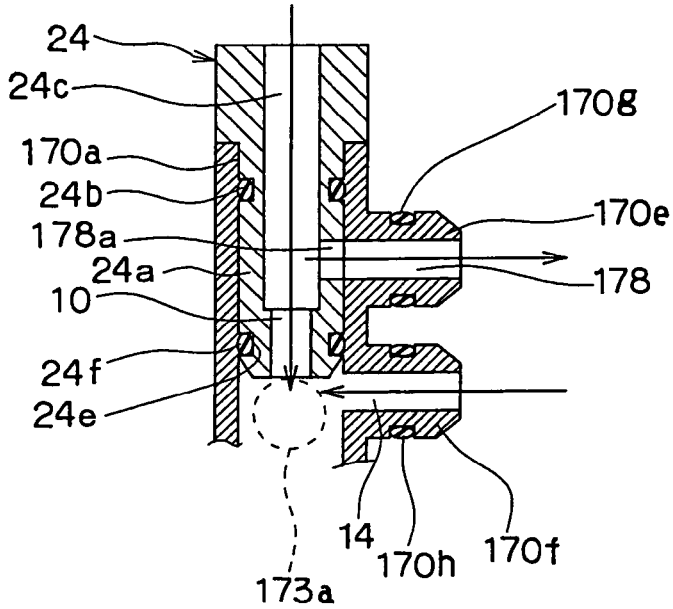
FIG. 18 is an enlarged sectional view showing a main part of the separator-integrated condenser shown in FIG. 17.
Figure 19:
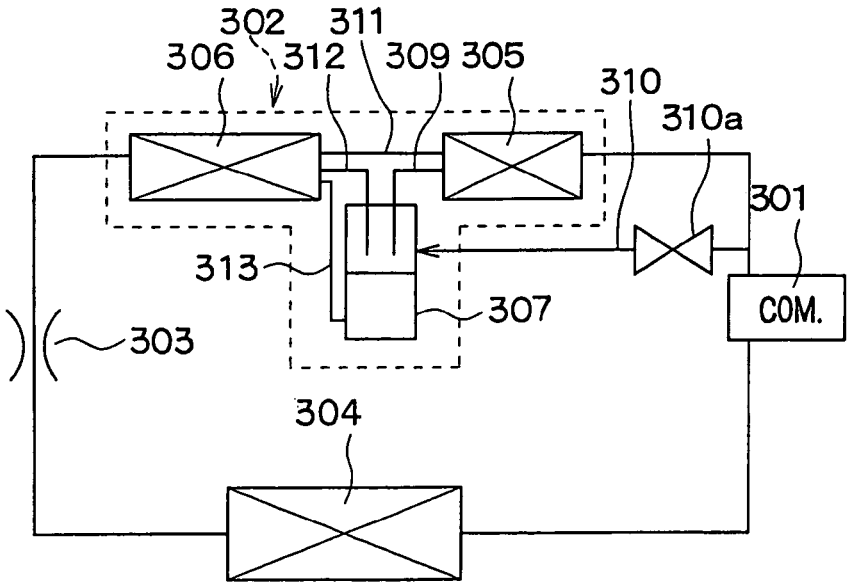
FIG. 19 PRIOR ART
FIG. 19 is a schematic diagram showing a conventional refrigerant cycle system.

In the sixth to eight embodiments, the inlet joint 24 is disposed in the gas-liquid separator 7, and both of the gas-refrigerant condensing passage 178 and the gas-refrigerant bypass passage 10 are provided in the tank body 170 of the gas-liquid separator 7. However, in the ninth embodiment, as shown in FIGS. 17, 18, a gas-refrigerant condensing passage 178*a* and the gas-refrigerant bypass passage 10 are provided in the inlet joint 24. Therefore, an axial dimension of the cylindrical projection 24*a* of the inlet joint 24 is made larger than that in the sixth to eighth embodiments. In this way, a bottom end of the cylindrical projection 24*a* is located around the liquid-refrigerant introduction passage 14, that is, at a portion directly above the gas-liquid mixing area 173*a*.

Further, the inlet joint 24 is provided with the gas-refrigerant bypass passage 10 around the bottom end of the passage hole 24*c*. A passage area (passage diameter) of the gas-refrigerant bypass passage 110 is set smaller by a predetermined area than that of the passage hole 24*c*. A through hole used as the gas-refrigerant condensing passage 178*a* is provided in an outer peripheral surface of the cylindrical projection 24*a* at a position facing the upper cylindrical projection 170*e* of the tank body 170. The gas-refrigerant condensing passage 178*a* of the inlet joint 24 communicates with the upper space 117*a* of the left header tank 117 through the gas-refrigerant condensing passage 178 of the tank body 170 and the passage hole 117*q* of the connection joint 117*p*. Here, the passage area (passage diameter) of the gas-refrigerant condensing passage 178*a* of the inlet joint 24 and the gas-refrigerant condensing passage 178 of the tank body 170 is made smaller than that of the passage hole 117*q* of the connection joint 117*p*. Therefore, the gas-refrigerant distribution amount into the first heat-exchanging portion 5 can be set by setting the passage area (passage diameter) of the gas-refrigerant condensing passages 178, 178*a* without receiving an affection due to the solder invasion.

The cylindrical projection 24*a* has an outer peripheral ditch 24*e* at its bottom end side with respect to the gas-refrigerant condensing passage 178*a*, and an O-ring 24*f* as an elastic seal member is attached to the outer peripheral ditch 24*e*. The O-ring 24*f* can prevent the discharged gas refrigerant in the gas-refrigerant condensing passage 178*a* from flowing into the gas-liquid mixing area 173*a* through a clearance between the outer peripheral surface of the cylindrical projection 24*a* and the inner peripheral surface of the tank body 170.

In the ninth embodiment, all of condensed refrigerant from the first heat exchanging portion 5 is introduced into the gas-liquid separator 7. In the ninth embodiment, the other parts are similar to those of the above-described seventh embodiment.

Although the present invention has been fully described in connection with the preferred embodiments thereof with reference to the accompanying drawings, it is to be noted that various changes and modifications will become apparent to those skilled in the art.

For example, in the above-described fifth to seventh and ninth embodiments, a part of liquid refrigerant condensed in the first heat-exchanging portion may be introduced into the gas-liquid separator 7 while the other part thereof is introduced into the second heat-exchanging portion 6, similarly to the eighth embodiment.

Such changes and modifications are to be understood as being within the scope of the present invention as defined by the appended claims.

What is claimed is:

1. A refrigerant cycle system comprising:

a compressor for compressing refrigerant;

a first heat-exchanging portion for cooling and condensing gas refrigerant discharged from the compressor by radiating heat;

a gas-liquid separator for separating refrigerant into gas refrigerant and liquid refrigerant, into which all of refrigerant after passing through the first heat-exchanging portion and a part of gas refrigerant discharged from the compressor are introduced;

a second heat-exchanging portion disposed downstream of the first heat-exchanging portion, for cooling and condensing refrigerant flowing from the gas-liquid separator by radiating heat;

a gas-refrigerant return passage through which at least gas refrigerant in the gas-liquid separator is introduced into the second heat-exchanging portion;

a decompression device disposed downstream of the second heat-exchanging portion, for decompressing refrigerant after passing through the second heat-exchanging portion; and an evaporator disposed downstream of the decompression device, for evaporating refrigerant flowing out of the decompression device.

2. The refrigerant cycle system according to claim 1, further comprising:

a refrigerant introduction passage through which all of the refrigerant discharged from the first heat-exchanging portion flows into the gas-liquid separator; and a gas refrigerant bypass passage through which gas refrigerant discharged from the compressor directly flows into the gas-liquid separator while bypassing the first heat-exchanging portion.

3. The refrigerant cycle system according to claim 1, further comprising a gas-liquid mixing portion in which all of refrigerant after passing through the first heat-exchanging portion and a part of gas refrigerant discharged from the compressor are introduced and mixed, wherein:

the gas-liquid separator has a refrigerant inlet from which refrigerant is introduced; and the gas-liquid mixing portion is connected to the refrigerant inlet of the gas-liquid separator.

4. The refrigerant cycle system according to claim 3, wherein:

first and second heat-exchanging portions are integrated to form a heat exchanging section, a first header tank and a second header tank of a condenser;

the heat exchanging section includes a plurality of tubes through which refrigerant flows;

the first header tank and the second header tank are disposed at two sides of the heat exchanging section to communicate with the tubes; and the gas-liquid mixing portion is provided in the first header tank.

5. The refrigerant cycle system according to claim 1, further comprising a liquid-refrigerant return passage through which a part of liquid refrigerant in the gas-liquid separator is introduced into an upstream position of the decompression device.

6. The refrigerant cycle system according to claim 5, wherein the liquid-refrigerant return passage communicates with an inlet side of the second heat-exchanging portion.

7. The refrigerant cycle system according to claim 5, wherein the liquid-refrigerant return passage communicates with an outlet side of the second heat-exchanging portion.

8. The refrigerant cycle system according to claim 2, further comprising a passage-area adjusting device disposed in the gas-refrigerant bypass passage, for adjusting a passage area of the gas-refrigerant bypass passage, wherein an amount of liquid refrigerant stored in the gas-liquid separator is controlled in accordance with a super-heating degree of gas refrigerant discharged from the compressor.

9. The refrigerant cycle system according to claim 8, further comprising an inlet portion from which gas refrigerant discharged from the compressor is introduced into the first heat-exchanging portion, wherein the inlet portion is provided in the first heat-exchanging portion, and the gas-refrigerant bypass passage and the passage-area adjusting device are provided in the first heat-exchanging portion.

10. The refrigerant cycle system according to claim 8, further comprising an inlet portion from which gas refrigerant discharged from the compressor is introduced into the first heat-exchanging portion, wherein:

the inlet portion is provided in the gas-liquid separator, and the gas-refrigerant bypass passage and the passage-area adjusting device are provided in the gas-liquid separator.

11. The refrigerant cycle system according to claim 8, wherein the passage-area adjusting device includes a valve body disposed rotatably for adjusting the passage area of the gas-refrigerant bypass passage.

12. The refrigerant cycle system according to claim 1, further comprising:

an inlet portion through which gas refrigerant discharged from the compressor is introduced into the first heat-exchanging portion, the inlet portion being disposed outside the first heat-exchanging portion;

a gas-refrigerant condensing passage through which the gas refrigerant discharged from the compressor is introduced from the inlet portion into the first heat-exchanging portion, the gas-refrigerant condensing passage being disposed outside the first heat-exchanging portion; and a gas-refrigerant bypass passage through which the gas refrigerant discharged from the compressor is directly introduced into the gas-liquid separator while bypassing the first heat-exchanging portion, the gas-refrigerant bypass passage being disposed outside the first heat-exchanging portion.

13. The refrigerant cycle system according to claim 12, wherein:

the gas-liquid separator includes a tank body having a gas-liquid separating space for separating refrigerant into gas refrigerant and liquid refrigerant; and the gas-refrigerant condensing passage and the gas-refrigerant bypass passage are provided in the tank body.

14. The refrigerant cycle system according to claim 12, wherein:

the inlet portion is formed to be separated from the gas-liquid separator, and is attached to the gas-liquid separator; and the gas-refrigerant condensing passage and the gas-refrigerant bypass passage are provided in the inlet portion.

15. The refrigerant cycle system according to claim 12, wherein:

the gas-liquid separator has a liquid-refrigerant return passage through which a part of liquid refrigerant in the gas-liquid separator flows;

the gas-refrigerant return passage is joined to the liquid-refrigerant return passage to form a mixing portion where gas refrigerant from the gas-refrigerant return passage and liquid refrigerant from the liquid-refrigerant return passage are mixed; and the mixing portion is provided in the gas-liquid separator such that refrigerant in the mixing portion is introduced into the second heat-exchanging portion.

16. A refrigerant cycle system comprising:

a compressor for compressing refrigerant;

a first heat-exchanging portion for cooling and condensing gas refrigerant discharged from the compressor by radiating heat;

a gas-liquid separator for separating refrigerant into gas refrigerant and liquid refrigerant, into which all of refrigerant after passing through the first heat-exchanging portion is introduced;

a second heat-exchanging portion disposed downstream of the first heat-exchanging portion, for cooling and condensing refrigerant flowing from the gas-liquid separator by radiating heat;

a gas-refrigerant return passage through which gas refrigerant in the gas-liquid separator is introduced into the second heat-exchanging portion;

a decompression device disposed downstream of the second heat-exchanging portion, for decompressing refrigerant after passing through the second heat-exchanging portion;

an evaporator disposed downstream of the decompression device, for evaporating refrigerant flowing out of the decompression device; and a heating unit for adjusting a heating amount of the liquid refrigerant in the gas-liquid separator in accordance with any one of a super-heating degree of gas refrigerant discharged from the compressor and a superheating degree of gas refrigerant at an outlet of the evaporator.

17. The refrigerant cycle system according to claim 16, further comprising a liquid-refrigerant return passage through which a part of liquid refrigerant in the gas-liquid separator is introduced into an upstream position of the decompression device.

18. The refrigerant cycle system according to claim 17, wherein the liquid-refrigerant return passage communicates with an inlet side of the second heat-exchanging portion.

19. The refrigerant cycle system according to claim 17, wherein the liquid-refrigerant return passage communicates with an outlet side of the second heat-exchanging portion.

* * * * *